US011806290B2

(12) United States Patent
Tessmer et al.

(10) Patent No.: US 11,806,290 B2
(45) **Date of Patent: *Nov. 7, 2023**

(54) ADJUSTABLE PATIENT SUPPORT APPARATUS FOR ASSISTED EGRESS AND INGRESS

(71) Applicant: Stryker Corporation, Kalamazoo, MI (US)

(72) Inventors: Brian J. Tessmer, Mattawan, MI (US); William V. Bleeker, Plainwell, MI (US); Connor F. St. John, Kalamazoo, MI (US); John P Zerbel, Paw Paw, MI (US); Justin R. Murray, Portage, MI (US)

(73) Assignee: Stryker Corporation, Kalamazoo, MI (US)

( * ) Notice: Subject to any disclaimer, the term of this patent is extended or adjusted under 35 U.S.C. 154(b) by 144 days.

This patent is subject to a terminal disclaimer.

(21) Appl. No.: 17/492,109

(22) Filed: Oct. 1, 2021

(65) Prior Publication Data

US 2022/0015969 A1 Jan. 20, 2022

Related U.S. Application Data

(63) Continuation of application No. 16/134,438, filed on Sep. 18, 2018, now Pat. No. 11,160,705.

(Continued)

(51) Int. Cl.
*A61G 7/015* (2006.01)
*A61G 7/075* (2006.01)

(Continued)

(52) U.S. Cl.
CPC ..... *A61G 7/015* (2013.01); *A61G 5/006* (2013.01); *A61G 5/14* (2013.01); *A61G 7/005* (2013.01);

(Continued)

(58) Field of Classification Search
CPC ..... A61G 7/015; A61G 7/0755; A61G 7/005; A61G 7/012; A61G 7/0504; A61G 7/0507;

(Continued)

(56) References Cited

U.S. PATENT DOCUMENTS 1,078 A * 2/1839 Cherrington ..... A61G 7/015 5/617
1,626,091 A 4/1927 Macklin (Continued)

FOREIGN PATENT DOCUMENTS

AU 783695 B2 11/2005
AU 2011232780 A1 4/2012

(Continued)

OTHER PUBLICATIONS

Astral Healthcare, "DOC Classic Opthalmology Day Surgery Chair Webpage and Video", 2017, 6 pages.

(Continued)

*Primary Examiner* — Eric J Kurilla
(74) *Attorney, Agent, or Firm* — Howard & Howard Attorneys PLLC

(57) ABSTRACT

An adjustable patient support apparatus comprises a base, a support frame, and a patient support deck. The patient support deck comprises articulating deck sections, such as a leg section, seat section, and a back section pivotally coupled together. One or more actuators may be configured to move the leg and/or back section between a lowered position and one or more raised positions. The seat section may include one or more articulating seats to assist with ingress and egress from the patient support apparatus. The one or more seats may be articulated manually or electrically via a lever or actuator.

18 Claims, 19 Drawing Sheets

Related U.S. Application Data

(60) Provisional application No. 62/574,776, filed on Oct. 20, 2017.

(51) Int. Cl.

| | |
|---|---|
| ***A61G 7/005*** | (2006.01) |
| ***A61G 7/012*** | (2006.01) |
| ***A61G 7/05*** | (2006.01) |
| ***A61G 7/018*** | (2006.01) |
| ***A61G 5/14*** | (2006.01) |
| ***A61G 5/00*** | (2006.01) |

(52) U.S. Cl.
CPC ..... *A61G 7/012* (2013.01); *A61G 7/018* (2013.01); *A61G 7/0504* (2013.01); *A61G 7/0507* (2013.01); *A61G 7/0527* (2016.11); *A61G 7/0755* (2013.01); *A61G 7/0513* (2016.11); *A61G 2203/30* (2013.01); *A61G 2203/34* (2013.01); *A61G 2203/36* (2013.01); *A61G 2203/44* (2013.01)

(58) Field of Classification Search
CPC ..... A61G 7/018; A61G 2203/36; A61G 2203/44; A61G 2203/34
See application file for complete search history.

(56) References Cited

U.S. PATENT DOCUMENTS

| | | | |
|---|---|---|---|
| 3,932,903 | A | 1/1976 | Adams et al. |
| RE28,754 | E | 3/1976 | Cook et al. |
| 4,064,574 | A | 12/1977 | Schnitzler |
| 4,175,263 | A | 11/1979 | Triplett et al. |
| 4,183,015 | A | 1/1980 | Drew et al. |
| 4,242,672 | A | 12/1980 | Gault |
| 4,387,888 | A | 6/1983 | Marinakis |
| 4,641,387 | A | 2/1987 | Bondy et al. |
| 4,691,962 | A | 9/1987 | Holdt |
| 4,787,104 | A | 11/1988 | Grantham |
| 4,805,249 | A | 2/1989 | Usman et al. |
| 4,862,529 | A | 9/1989 | Peck |
| 4,959,878 | A | 10/1990 | Essek |
| 4,985,946 | A | 1/1991 | Foster et al. |
| 5,084,925 | A | 2/1992 | Cook |
| 5,134,737 | A | 8/1992 | Wyman |
| 5,154,186 | A | 10/1992 | Laurin et al. |
| 5,173,975 | A | 12/1992 | Peterson |
| 5,208,928 | A | 5/1993 | Kuck et al. |
| 5,230,113 | A | 7/1993 | Foster et al. |
| 5,231,721 | A | 8/1993 | Fish |
| 5,299,334 | A | 4/1994 | Gonzalez |
| 5,354,022 | A | 10/1994 | Coonrod |
| 5,398,357 | A | 3/1995 | Foster |
| 5,411,044 | A | 5/1995 | Andolfi |
| 5,454,126 | A | 10/1995 | Foster et al. |
| 5,479,666 | A | 1/1996 | Foster et al. |
| 5,526,541 | A | 6/1996 | Massey et al. |
| 5,555,582 | A | 9/1996 | Jerideau |
| 5,577,279 | A | 11/1996 | Foster et al. |
| 5,680,661 | A | 10/1997 | Foster et al. |
| 5,708,997 | A | 1/1998 | Foster et al. |
| 5,715,548 | A | 2/1998 | Weismiller et al. |
| 5,732,423 | A | 3/1998 | Weismiller et al. |
| 5,745,937 | A | 5/1998 | Weismiller et al. |
| 5,790,997 | A | 8/1998 | Ruehl |
| 5,842,237 | A | 12/1998 | Hargest et al. |
| 5,844,488 | A | 12/1998 | Musick |
| 5,916,085 | A | 6/1999 | Wells |
| 5,933,888 | A | 8/1999 | Foster et al. |
| 5,940,910 | A | 8/1999 | Weismiller et al. |
| 5,950,262 | A | 9/1999 | Smoler et al. |
| 5,987,673 | A | 11/1999 | Smith |
| 6,009,570 | A | 1/2000 | Hargest et al. |
| 6,112,345 | A | 9/2000 | Foster et al. |
| 6,141,806 | A | 11/2000 | Bobey et al. |
| 6,163,903 | A | 12/2000 | Weismiller et al. |
| 6,182,310 | B1 | 2/2001 | Weismiller et al. |
| 6,240,583 | B1 | 6/2001 | Brooke et al. |
| 6,256,822 | B1 | 7/2001 | Weston et al. |
| 6,336,235 | B1 | 1/2002 | Ruehl |
| 6,427,264 | B1 | 8/2002 | Metz et al. |
| 6,430,763 | B2 | 8/2002 | Kosumsuppamala et al. |
| 6,453,491 | B1 | 9/2002 | Wells et al. |
| 6,539,569 | B2 | 4/2003 | O'Connell |
| 6,584,628 | B1 | 7/2003 | Kummer et al. |
| 6,629,326 | B2 | 10/2003 | Rabe |
| 6,640,360 | B2 | 11/2003 | Hornbach et al. |
| 6,694,548 | B2 | 2/2004 | Foster et al. |
| 6,701,545 | B1 | 3/2004 | Ferneau et al. |
| 6,715,784 | B2 | 4/2004 | Koerlin et al. |
| 6,725,474 | B2 | 4/2004 | Foster et al. |
| 6,820,293 | B2 | 11/2004 | Alverson |
| 6,829,793 | B2 | 12/2004 | Brooke et al. |
| 6,928,673 | B2 | 8/2005 | Risk, Jr. |
| 6,941,598 | B2 | 9/2005 | Ferrand et al. |
| 6,971,132 | B2 | 12/2005 | Feinsod |
| 6,978,501 | B2 | 12/2005 | Vrzalik |
| 7,000,272 | B2 | 2/2006 | Allen et al. |
| 7,058,999 | B2 | 6/2006 | Horitani et al. |
| 7,073,219 | B2 | 7/2006 | Poulin et al. |
| 7,197,779 | B2 | 4/2007 | Shalikar |
| 7,200,882 | B2 | 4/2007 | Heimbrock |
| 7,213,279 | B2 | 5/2007 | Weismiller et al. |
| 7,251,845 | B2 | 8/2007 | Schaller et al. |
| 7,253,366 | B2 | 8/2007 | Bhai |
| 7,319,386 | B2 | 1/2008 | Collins, Jr. et al. |
| 7,406,731 | B2 | 8/2008 | Menkedick et al. |
| 7,415,740 | B1 | 8/2008 | Kemper |
| 7,430,770 | B2 | 10/2008 | Ramirez |
| 7,458,119 | B2 | 12/2008 | Hornbach et al. |
| 7,520,006 | B2 | 4/2009 | Menkedick et al. |
| 7,520,009 | B1 | 4/2009 | Heck |
| 7,559,101 | B2 | 7/2009 | Vrzalik et al. |
| 7,568,247 | B2 | 8/2009 | Strobel et al. |
| 7,673,353 | B1 | 3/2010 | Khodabandeh |
| 7,690,059 | B2 | 4/2010 | Lemire et al. |
| 7,694,368 | B2 | 4/2010 | Lewis, Jr. |
| 7,716,762 | B2 | 5/2010 | Ferraresi et al. |
| 7,761,939 | B2 | 7/2010 | Wiggins et al. |
| 7,761,942 | B2 | 7/2010 | Benzo et al. |
| 7,784,128 | B2 | 8/2010 | Kramer |
| 7,788,747 | B2 | 9/2010 | Kramer et al. |
| 7,788,748 | B2 | 9/2010 | Wurdeman |
| 7,805,782 | B2 | 10/2010 | Hakamiun et al. |
| 7,845,034 | B2 | 12/2010 | Kim |
| 7,886,379 | B2 | 2/2011 | Benzo et al. |
| 7,905,242 | B2 | 3/2011 | Kline |
| 7,917,978 | B2 | 4/2011 | Ruschke et al. |
| 8,042,206 | B2 | 10/2011 | Genaro |
| 8,065,764 | B2 | 11/2011 | Kramer |
| 8,104,118 | B2 | 1/2012 | Derenne et al. |
| RE43,155 | E | 2/2012 | Allen et al. |
| 8,127,380 | B2 | 3/2012 | Wurdeman |
| 8,156,586 | B2 | 4/2012 | Reed et al. |
| RE43,532 | E | 7/2012 | Menkedick et al. |
| 8,239,983 | B2 | 8/2012 | Chinn |
| 8,272,087 | B2 | 9/2012 | Westermann |
| 8,296,884 | B2 | 10/2012 | Heimbrock |
| 8,336,133 | B2 | 12/2012 | Palay et al. |
| 8,336,134 | B2 | 12/2012 | Jelinek |
| 8,341,779 | B2 | 1/2013 | Hornbach et al. |
| 8,353,071 | B2 | 1/2013 | Turner et al. |
| 8,413,270 | B2 | 4/2013 | Turner et al. |
| 8,413,273 | B2 | 4/2013 | Hornbach et al. |
| 8,413,274 | B2 | 4/2013 | Weismiller et al. |
| 8,453,283 | B2 | 6/2013 | O'Keefe |
| 8,474,072 | B2 | 7/2013 | O'Keefe et al. |
| 8,474,921 | B2 | 7/2013 | Newkirk et al. |
| 8,495,774 | B2 | 7/2013 | Soltani |
| 8,516,637 | B2 | 8/2013 | Karwal et al. |
| 8,522,379 | B2 | 9/2013 | Turner |
| 8,578,531 | B2 | 11/2013 | Abernathey et al. |
| 8,631,524 | B2 | 1/2014 | Derenne et al. |

(56) References Cited

U.S. PATENT DOCUMENTS

| | | | |
|---|---|---|---|
| 8,640,285 | B2 | 2/2014 | Heimbrock et al. |
| 8,646,124 | B2 | 2/2014 | Stryker et al. |
| 8,677,535 | B2 | 3/2014 | Turner |
| 8,689,376 | B2 | 4/2014 | Becker et al. |
| 8,713,727 | B2 | 5/2014 | Heimbrock et al. |
| 8,732,875 | B2 | 5/2014 | O'Keefe |
| 8,745,786 | B2 | 6/2014 | Andrienko et al. |
| 8,756,735 | B2 | 6/2014 | Heimbrock et al. |
| 8,793,824 | B2 | 8/2014 | Poulos et al. |
| 8,826,475 | B2 | 9/2014 | Jackson |
| 8,844,075 | B2 | 9/2014 | Heimbrock |
| 8,844,078 | B2 | 9/2014 | Hornbach et al. |
| 8,863,331 | B2 | 10/2014 | Valentino et al. |
| 8,887,329 | B2 | 11/2014 | Soltani |
| 8,910,329 | B2 | 12/2014 | Turner et al. |
| 8,959,680 | B2 | 2/2015 | Tesar et al. |
| 8,959,681 | B2 | 2/2015 | Richards |
| 8,973,186 | B2 | 3/2015 | Bhai |
| 8,973,187 | B2 | 3/2015 | Hornbach |
| 9,013,313 | B2 | 4/2015 | Paine |
| 9,038,214 | B2 | 5/2015 | Hardin |
| 9,079,089 | B2 | 7/2015 | Lokken et al. |
| 9,125,758 | B2 | 9/2015 | Skreosen |
| 9,125,785 | B2 | 9/2015 | Trees |
| 9,138,173 | B2 | 9/2015 | Penninger et al. |
| 9,149,403 | B2 | 10/2015 | Turner et al. |
| 9,173,797 | B2 | 11/2015 | Andrienko |
| 9,179,863 | B2 | 11/2015 | Brauers et al. |
| 9,216,123 | B2 | 12/2015 | Tekulve |
| 9,253,891 | B2 | 2/2016 | Williams |
| 9,265,677 | B2 | 2/2016 | Manouchehri et al. |
| 9,277,827 | B2 | 3/2016 | Hornbach et al. |
| 9,329,076 | B2 | 5/2016 | Meyer et al. |
| 9,552,714 | B2 | 1/2017 | Ribble et al. |
| 9,978,244 | B2 | 5/2018 | Ribble et al. |
| 11,160,705 | B2 * | 11/2021 | Tessmer ..... A61G 7/018 |
| 2002/0056160 | A1 | 5/2002 | Falbo et al. |
| 2003/0167568 | A1 | 9/2003 | Brooke |
| 2004/0019967 | A1 | 2/2004 | Gant |
| 2004/0074414 | A1 | 4/2004 | Phillips |
| 2004/0158923 | A1 | 8/2004 | Perez et al. |
| 2005/0011006 | A1 | 1/2005 | Ellen et al. |
| 2005/0235418 | A1 | 10/2005 | Jacques et al. |
| 2006/0053555 | A1 | 3/2006 | Poulos et al. |
| 2006/0085914 | A1 | 4/2006 | Peterson et al. |
| 2007/0038155 | A1 | 2/2007 | Kelly et al. |
| 2007/0089238 | A1 | 4/2007 | Kramer et al. |
| 2007/0169269 | A1 | 7/2007 | Wells |
| 2008/0120810 | A1 | 5/2008 | Reckelhoff et al. |
| 2009/0044334 | A1 | 2/2009 | Parsell et al. |
| 2009/0077747 | A1 | 3/2009 | Kim |
| 2009/0094745 | A1 | 4/2009 | Benzo et al. |
| 2009/0126114 | A1 | 5/2009 | Kral et al. |
| 2010/0005592 | A1 | 1/2010 | Poulos et al. |
| 2010/0017964 | A1 | 1/2010 | Kruse |
| 2010/0064439 | A1 | 3/2010 | Soltani |
| 2010/0170041 | A1 | 7/2010 | Heimbrock et al. |
| 2010/0212087 | A1 | 8/2010 | Leib et al. |
| 2010/0229299 | A1 | 9/2010 | Lear |
| 2011/0030138 | A1 | 2/2011 | Kawakami et al. |
| 2011/0068932 | A1 | 3/2011 | Flocard et al. |
| 2011/0314602 | A1 | 12/2011 | Stryker et al. |
| 2012/0023670 | A1 | 2/2012 | Zerhusen et al. |
| 2012/0096644 | A1 | 4/2012 | Heimbrock |
| 2012/0110741 | A1 | 5/2012 | Mears et al. |
| 2012/0117732 | A1 | 5/2012 | O'Keefe |
| 2012/0124745 | A1 | 5/2012 | Heimbrock et al. |
| 2012/0124746 | A1 | 5/2012 | Andrienko et al. |
| 2012/0137439 | A1 | 6/2012 | Heimbrock |
| 2012/0137440 | A1 | 6/2012 | Richards |
| 2012/0144588 | A1 | 6/2012 | Heimbrock et al. |
| 2012/0198626 | A1 | 8/2012 | Richards |
| 2012/0198628 | A1 | 8/2012 | Richards |
| 2012/0204351 | A1 | 8/2012 | Revenus et al. |
| 2012/0246830 | A1 | 10/2012 | Hornbach |
| 2013/0086746 | A1 | 4/2013 | Vanderpohl |
| 2013/0125310 | A1 | 5/2013 | Manouchehri |
| 2013/0212807 | A1 | 8/2013 | Manson et al. |
| 2014/0259420 | A1 | 9/2014 | Lambarth et al. |
| 2014/0265181 | A1 | 9/2014 | Lambarth et al. |
| 2014/0265497 | A1 | 9/2014 | Hough et al. |
| 2014/0313030 | A1 | 10/2014 | Ten Kate et al. |
| 2014/0327232 | A1 | 11/2014 | He |
| 2014/0331410 | A1 | 11/2014 | Heimbrock et al. |
| 2014/0333440 | A1 | 11/2014 | Kiani |
| 2014/0343889 | A1 | 11/2014 | Ben Shalom et al. |
| 2015/0135440 | A1 | 5/2015 | Chiacchira et al. |
| 2015/0164722 | A1 | 6/2015 | Roussy et al. |
| 2015/0231010 | A1 | 8/2015 | Nilsson et al. |
| 2015/0238123 | A1 | 8/2015 | Yakam et al. |
| 2015/0297432 | A1 | 10/2015 | Poulos et al. |
| 2015/0305955 | A1 | 10/2015 | Simmonds et al. |
| 2015/0320625 | A1 | 11/2015 | White |
| 2016/0022039 | A1 | 1/2016 | Paul et al. |
| 2016/0120717 | A1 | 5/2016 | Wurdeman |
| 2016/0128885 | A1 | 5/2016 | Latney |
| 2016/0140307 | A1 * | 5/2016 | Brosnan ..... G06Q 10/10 600/509 |
| 2016/0193095 | A1 | 7/2016 | Roussy et al. |
| 2016/0213538 | A1 | 7/2016 | Salus |
| 2016/0302985 | A1 | 10/2016 | Tessmer et al. |
| 2016/0310336 | A1 | 10/2016 | Ertelt |
| 2016/0310340 | A1 | 10/2016 | Heidingsfelder-Bongard et al. |
| 2016/0367420 | A1 | 12/2016 | Zerhusen et al. |
| 2017/0056262 | A1 | 3/2017 | Yamada et al. |
| 2017/0124844 | A1 | 5/2017 | Huster et al. |
| 2017/0128295 | A1 | 5/2017 | Tekulve |
| 2017/0172829 | A1 | 6/2017 | Tessmer et al. |
| 2017/0266068 | A1 | 9/2017 | Scott et al. |
| 2017/0281438 | A1 | 10/2017 | Elku et al. |
| 2018/0000673 | A1 | 1/2018 | Bartley |
| 2018/0116885 | A1 | 5/2018 | St. John et al. |
| 2019/0083338 | A1 | 3/2019 | Childs et al. |
| 2019/0117483 | A1 | 4/2019 | Tessmer et al. |

FOREIGN PATENT DOCUMENTS

| | | | |
|---|---|---|---|
| CA | 2018815 | C | 11/1999 |
| CA | 2293085 | A1 | 6/2001 |
| CA | 2696686 | C | 1/2015 |
| CN | 101077325 | A | 11/2007 |
| CN | 201905562 | U | 7/2011 |
| CN | 202843982 | U | 4/2013 |
| CN | 101868215 | B | 8/2013 |
| CN | 204192905 | U | 3/2015 |
| CN | 204379588 | U | 6/2015 |
| CN | 204814540 | U | 12/2015 |
| DE | 2749146 | A1 | 5/1978 |
| DE | 4039253 | A1 | 6/1992 |
| DE | 19634419 | A1 | 3/1998 |
| DE | 202004003299 | U1 | 5/2004 |
| EP | 0375206 | B1 | 3/1994 |
| EP | 0746298 | B1 | 3/2003 |
| EP | 0932385 | B1 | 3/2004 |
| EP | 0957877 | B1 | 4/2005 |
| EP | 1545345 | A1 | 6/2005 |
| EP | 1789278 | A2 | 5/2007 |
| EP | 1416897 | B1 | 5/2008 |
| EP | 1487392 | B1 | 5/2008 |
| EP | 1459722 | B1 | 6/2010 |
| EP | 1976433 | B1 | 3/2011 |
| EP | 2484326 | A2 | 8/2012 |
| EP | 2484326 | A3 | 12/2012 |
| EP | 1693037 | B1 | 1/2013 |
| EP | 1948109 | A4 | 4/2013 |
| EP | 2174670 | B1 | 4/2013 |
| EP | 2174631 | B1 | 6/2013 |
| EP | 2462911 | A3 | 9/2013 |
| EP | 2275071 | B1 | 11/2013 |
| EP | 2151222 | B1 | 3/2014 |
| EP | 2716269 | A1 | 4/2014 |
| EP | 2462912 | B1 | 11/2014 |
| EP | 2863858 | A4 | 10/2015 |
| EP | 1916926 | B1 | 11/2015 |

(56) References Cited

FOREIGN PATENT DOCUMENTS

| | | | |
|---|---|---|---|
| EP | 2481388 | B1 | 11/2015 |
| EP | 2327385 | B1 | 3/2016 |
| EP | 2854602 | B1 | 9/2016 |
| GB | 905708 | A | 9/1962 |
| GB | 1212107 | A | 11/1970 |
| GB | 2185883 | A | 8/1987 |
| JP | H03151913 | A | 6/1991 |
| JP | H04341264 | A | 11/1992 |
| JP | H0731644 | A | 2/1995 |
| JP | H11104190 | A | 4/1999 |
| JP | 2002095703 | A | 4/2002 |
| JP | 2005066250 | A | 3/2005 |
| JP | 4854665 | B2 | 1/2012 |
| JP | 2013240601 | A | 12/2013 |
| JP | 2014188340 | A | 10/2014 |
| JP | 2015107283 | A | 6/2015 |
| KR | 20130076922 | A | 7/2013 |
| KR | 20130111088 | A | 10/2013 |
| TW | 201316976 | A | 5/2013 |
| WO | 9219203 | A1 | 11/1992 |
| WO | 9520933 | A1 | 8/1995 |
| WO | 1998007402 | A1 | 2/1998 |
| WO | 2004014193 | A1 | 2/2004 |
| WO | 2006023447 | A2 | 3/2006 |
| WO | 2006056146 | A1 | 6/2006 |
| WO | W02006138252 | A2 | 12/2006 |
| WO | 2007055051 | A1 | 5/2007 |
| WO | 2007145544 | A1 | 12/2007 |
| WO | 2008130741 | A2 | 10/2008 |
| WO | 2009029996 | A1 | 3/2009 |
| WO | 2011113070 | A1 | 9/2011 |
| WO | 2013096861 | A1 | 6/2013 |
| WO | 2013192411 | A2 | 12/2013 |
| WO | 2014029988 | A1 | 2/2014 |
| WO | 2015126742 | A1 | 8/2015 |
| WO | 2016171746 | A1 | 10/2016 |

OTHER PUBLICATIONS

English language abstract and machine-assisted English translation for JPH 04-341264 extracted from espacenet.com database on Jan. 2, 2019, 9 pages.
English language abstract and machine-assisted English translation for CN 101077325 extracted from espacenet.com database on Oct. 24, 2018, 7 pages.
English language abstract and machine-assisted English translation for CN 201905562 extracted from espacenet.com database on Oct. 24, 2018, 8 pages.
English language abstract and machine-assisted English translation for CN 202843982 extracted from espacenet.com database on Oct. 24, 2018, 7 pages.
English language abstract and machine-assisted English translation for CN 204192905 extracted from espacenet.com database on Oct. 24, 2018, 8 pages.
English language abstract and machine-assisted English translation for CN 204814540 extracted from espacenet.com database on Jan. 2, 2019, 10 pages.
English language abstract and machine-assisted English translation for CN204379588 extracted from espacenet.com database on Oct. 24, 2018, 8 pages.
English language abstract and machine-assisted English translation for DE 196 34 419 extracted from espacenet.com database on Oct. 24, 2018, 6 pages.
English language abstract and machine assisted English translation for DE 20 2004 003 299 extracted from espacenet.com database on Jan. 2, 2019, 8 pages.
English language abstract and machine-assisted English translation for DE 27 49 146 extracted from espacenet.com database on Oct. 24, 2018, 17 pages.
English language abstract and machine-assisted English translation for DE 40 39 253 extracted from espacenet.com database on Oct. 24, 2018, 7 pages.
English language abstract and machine-assisted English translation for JP 2002-095703 extracted from espacenet.com database on Oct. 24, 2018, 12 pages.
English language abstract and machine-assisted English translation for JP 2005-066250 extracted from espacenet.com database on Jan. 2, 2019, 9 pages.
English language abstract and machine-assisted English translation for JP 2014-188340 extracted from espacenet.com database on Oct. 24, 2018, 10 pages.
English language abstract and machine-assisted English translation for JP 2015-107283 extracted from espacenet.com database on Oct. 24, 2018, 19 pages.
English language abstract and machine-assisted English translation for JPH 03-151913 extracted from espacenet.com database on Jan. 2, 2019, 5 pages.
English language abstract and machine-assisted English translation for JPH 07-31644 extracted from espacenet.com database on Oct. 24, 2018, 6 pages.
English language abstract and machine-assisted English translation for JPH 11-104190 extracted from espacenet.com database on Jan. 2, 2019, 15 pages.
English language abstract and machine-assisted English translation for KR 2013-0076922 extracted from espacenet.com database on Oct. 24, 2018, 8 pages.
English language abstract and machine-assisted English translation for KR 2013-0111088 extracted from espacenet.com database on Oct. 24, 2018, 11 pages.
English language abstract and machine-assisted English translation for TW 201316976 extracted from espacenet.com database on Jan. 2, 2019, 12 pages.
English language abstract for CN 101868215 extracted from espacenet.com database on Oct. 24, 2018, 2 pages.
English language abstract for JP 2013-240601 extracted from espacenet.com database on Oct. 24, 2018, 2 pages.
English language abstract for WO 2007/055051 and machine-assisted English translation for corresponding JP 2007-130055 extracted from espacenet.com database on Jan. 2, 2019, 17 pages.
Ford Motor Company, "Memory Seat Escape Video", https://www.youtube.com/watch?v=xlghNmAK-7A, 2013, 2 pages.
Hill-Rom, "Centrella Smart+Bed Brochure" 2017, 11 pages.
Hill-Rom, "Centrella Smart+Bed Therapeutic Surfaces Brochure", Sep. 20, 2017, 3 pages.
Hill-Rom, "The Hill-Rom 900 Accella Bed Brochure", May 12, 2017, 16 pages.
Inkbed, "Brand New Model InkBed Patened Fully Adjustable Tattoo Table & Bed Webpage", http://www.inkbed.com/brand-new-model-inkbed-patented-fully-adjustable-tattoo-table-bed/, 2019, 3 pages.
Machine-assisted English translation for JP 4854665 extracted from espacenet.com database on Jan. 2, 2019, 31 pages.
Supportec Trade, "Surgery Chairs-Classic and Maxi Webpages", https://supportec-trade.nl/ formerly http://www.dogemedical.com/pages/en/products/surgery-chairs/doc-classic.php, 2017, 10 pages.
Ultracomfort America Furniture Manufacturing, "UltraComfort Stellar UC550 Large Lift Chair Webpage and Video", https://www.recliners.la/products/ultra-comfort-stellar-550-large-lift-chair, 2018, 3 pages.
U.S. Appl. No. 16/020,085, filed Jun. 27, 2018.
U.S. Appl. No. 16/134,004, filed Sep. 18, 2018.
U.S. Appl. No. 16/134,048, filed Sep. 18, 2018.
U.S. Appl. No. 16/134,438, filed Sep. 18, 2018.

* cited by examiner

FIG. 23
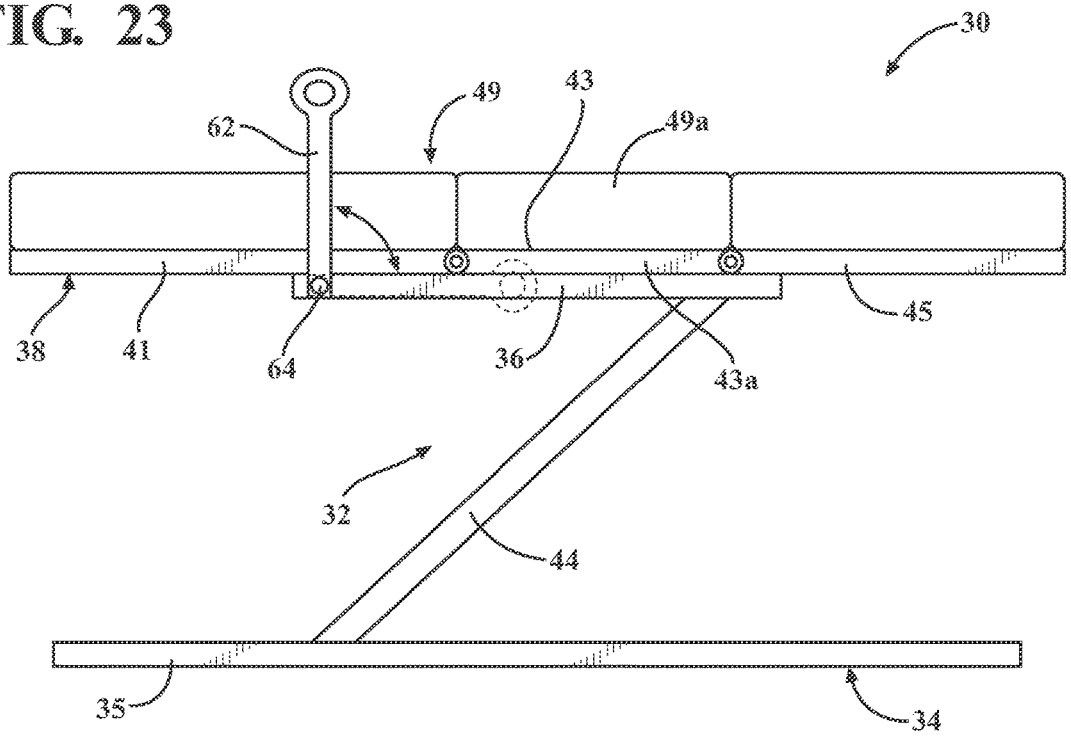
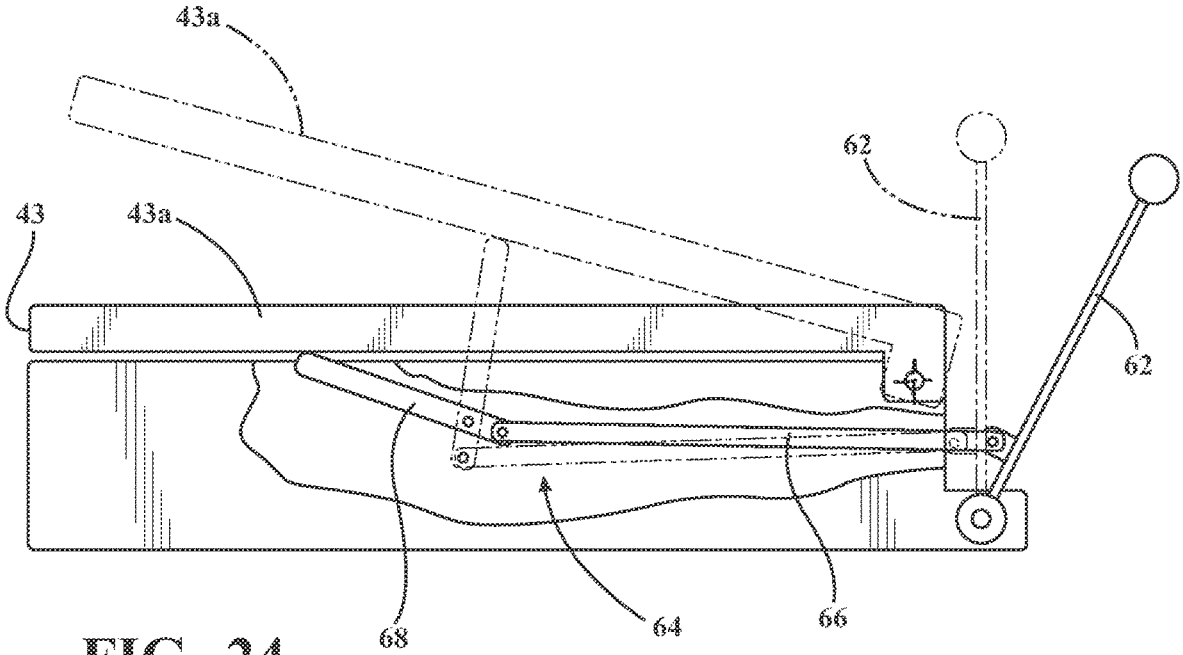
FIG. 24

ADJUSTABLE PATIENT SUPPORT APPARATUS FOR ASSISTED EGRESS AND INGRESS

RELATED APPLICATIONS

This application is a Continuation of U.S. patent application Ser. No. 16/134,438, filed on Sep. 18, 2018, which claims priority to and the benefit of U.S. Provisional Patent Application No. 62/574,776, filed on Oct. 20, 2017, the disclosures of each of which are hereby incorporated by reference in their entirety.

BACKGROUND

Patient support apparatuses, such as hospital beds, stretchers, cots, tables, wheelchairs, and chairs facilitate care of patients in a health care setting. Conventional patient support apparatuses comprise a base, a support frame, and a patient support deck upon which the patient is supported. The patient support deck usually comprises several deck sections capable of articulating relative to one another, such as a back section, a seat section, a leg section, and a foot section. These deck sections can be positioned in several different configurations.

Often, the various sections of the patient support deck may be pivotally coupled together and be configured to be raised and/or lowered to provide a comfortable position and/or facilitate care of patients in a health care setting. However, entering and exiting the patient support apparatus may be difficult for the patient. This can be especially true if the patient has limited strength and/or range of motion.

Therefore, a patient support apparatus with one or more adjustable deck sections designed to overcome one or more of the aforementioned disadvantages is desired.

BRIEF DESCRIPTION OF THE DRAWINGS

Advantages of the present disclosure will be readily appreciated as the same becomes better understood by reference to the following detailed description when considered in connection with the accompanying drawings wherein:

FIG. 23 is a side view of an alternative embodiment of the patient support apparatus including a handle.

FIG. 24 is a sectional view of an example embodiment of mechanical linkage configured to transition the seat section from a bed configuration to an egress configuration.

DETAILED DESCRIPTION

Figure 1:
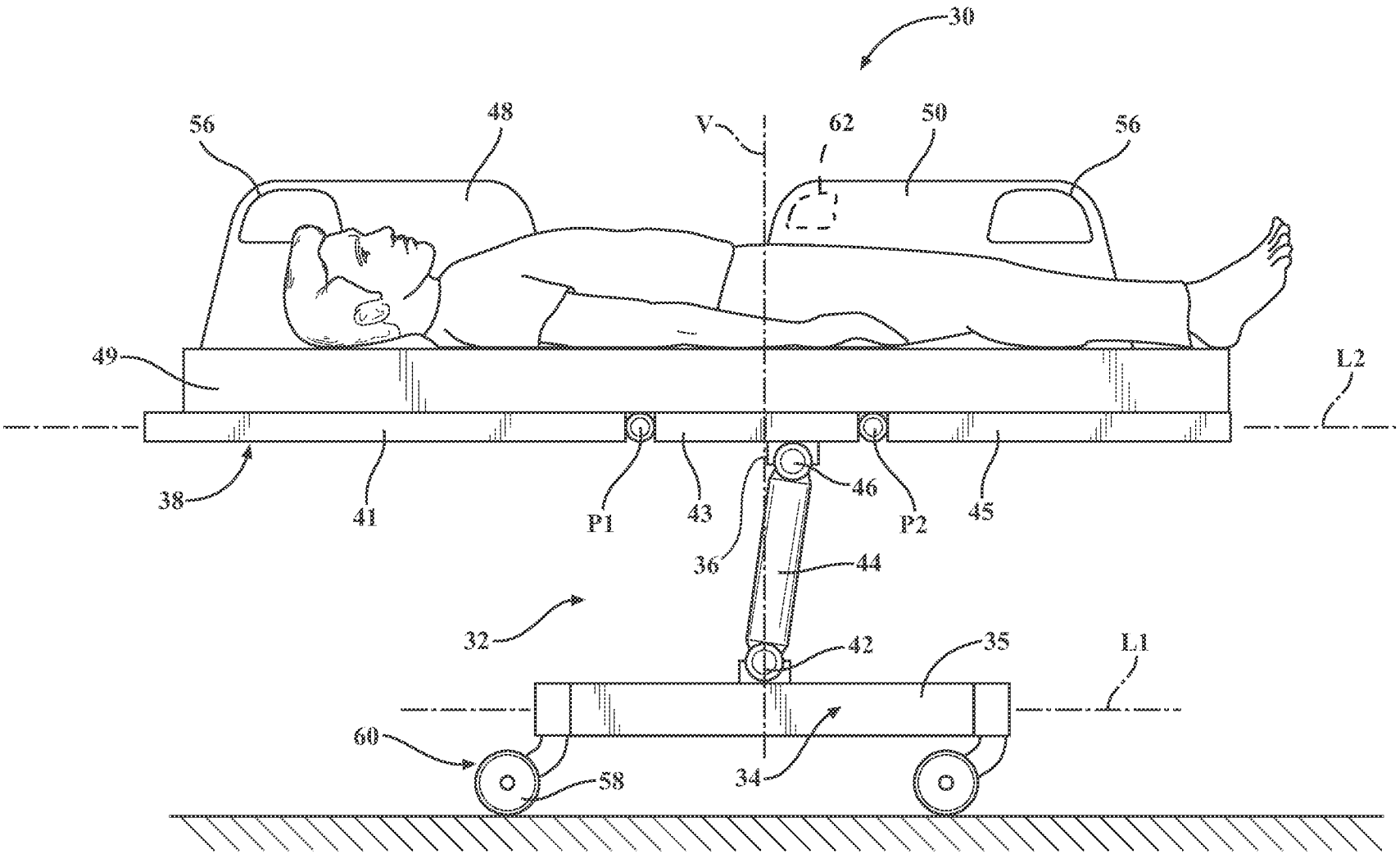
FIG. 1 is a side view of a patient support apparatus.
Figure 2:
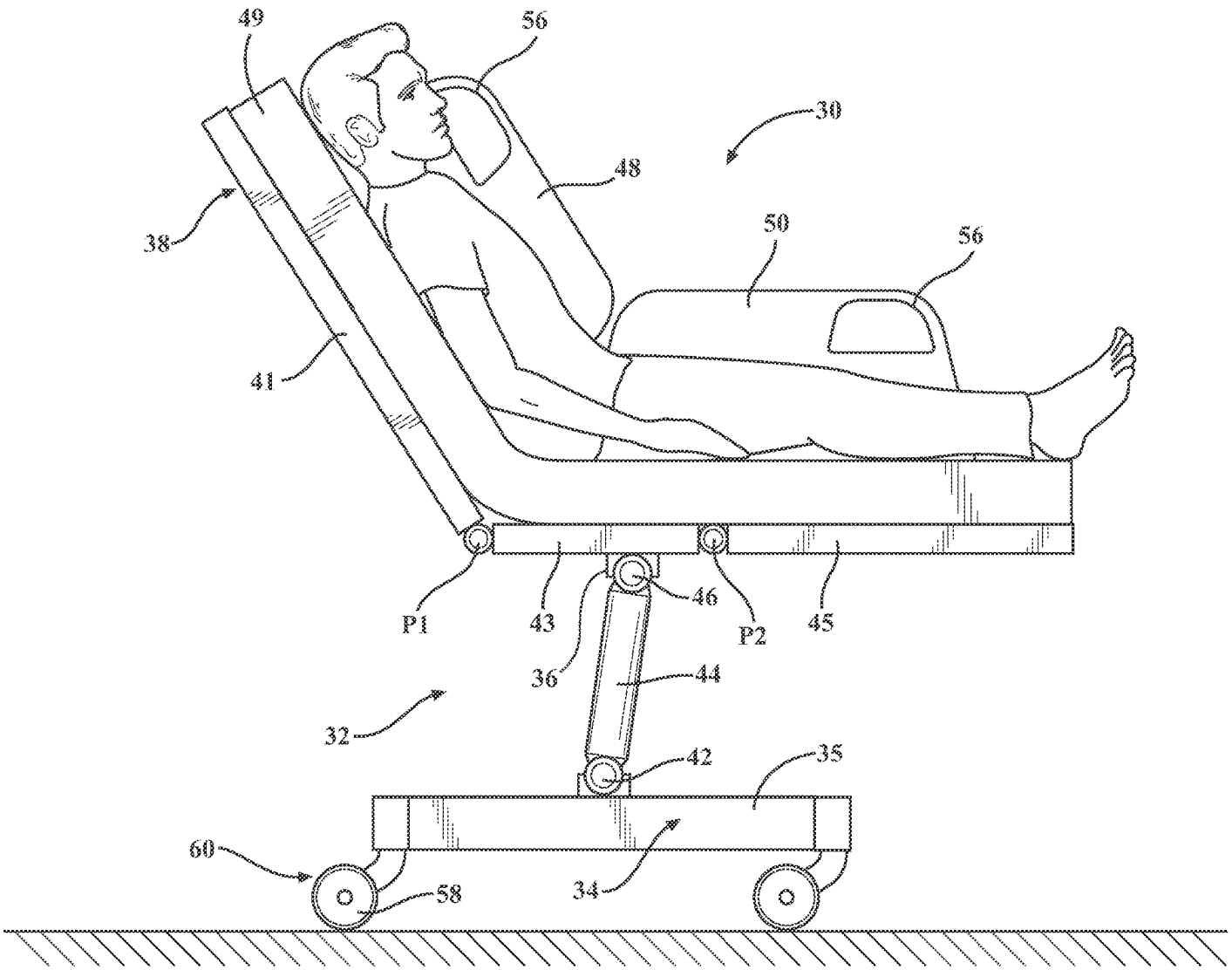
FIG. 2 is a side view of the patient support apparatus of FIG. 1 with raised back section of the support deck.
Figure 3:
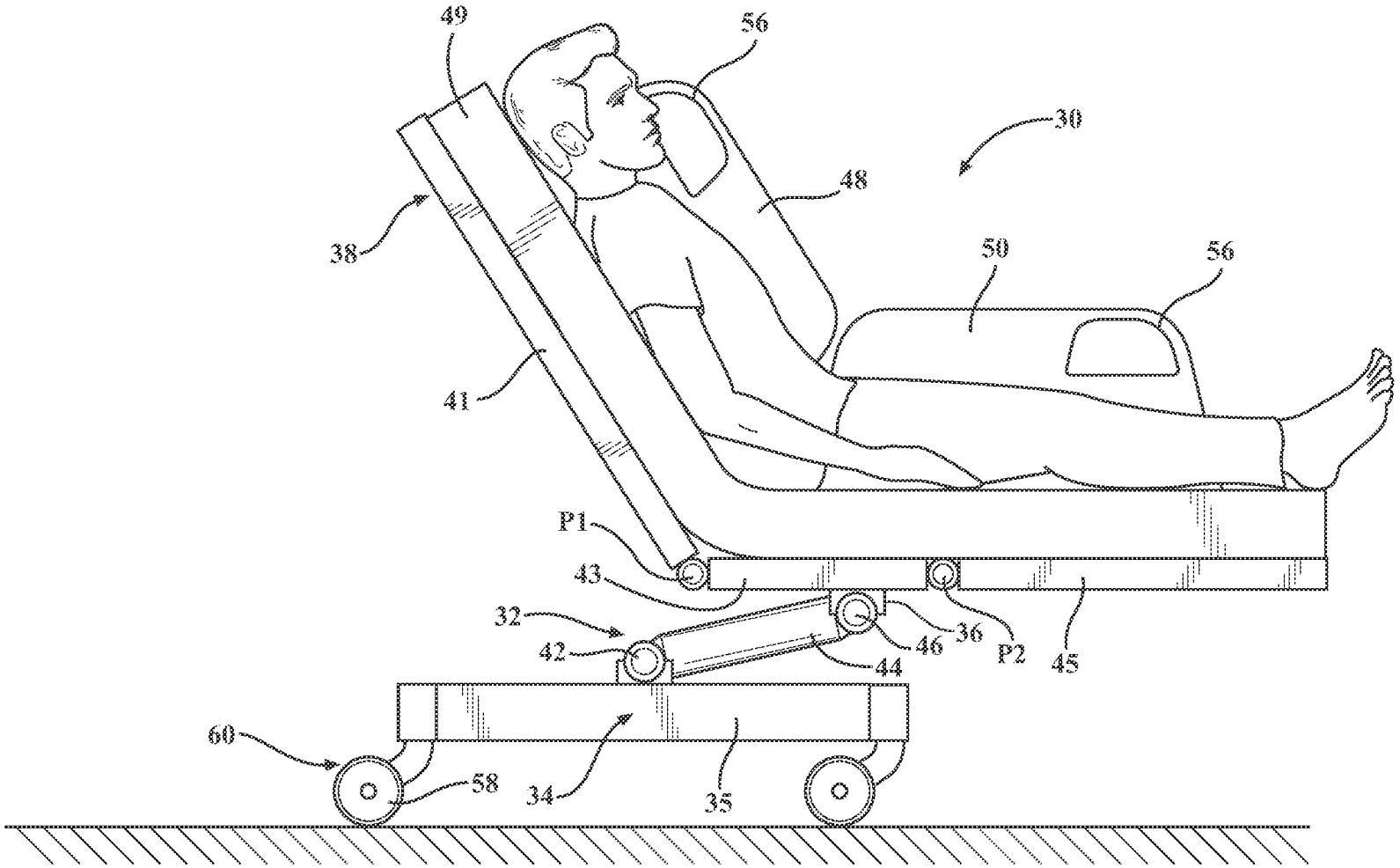
FIG. 3 is a side view of the patient support apparatus of FIG. 1 in a lowered configuration.

Referring to FIGS. 1-3, a patient support apparatus 30 is shown for supporting a patient in a health care setting. The patient support apparatus 30 illustrated in FIGS. 1-3 comprises a hospital bed. In other embodiments, however, the patient support apparatus 30 may comprise a stretcher, cot, table, wheelchair, chair, or similar apparatus utilized in the care of a patient.

A support structure 32 provides support for the patient. The support structure 32 comprises a base 34, a support frame 36, a patient support deck 38, and a lift member 44. The base 34 comprises a base frame 35. The lift member 44 may be configured to interconnect the base frame 35 and the support frame 36 via one or more actuators, such as the first and second actuators 42, 46, illustrated in FIGS. 1-3. The combination of the lift member 44 and the actuators 42, 46 may be generally referred to as a lift mechanism. The lift mechanism may be manipulated so the height of the patient support deck 38 is positioned at a maximum height (see, e.g., FIGS. 1 and 2), a minimum height (see, e.g., FIG. 3), or any intermediate height in between the maximum and minimum heights.

In the representative embodiment illustrated herein, the actuators 42, 46 are each realized as electrically-powered rotary actuators which cooperate to effect movement of the patient support deck 38 relative to the base 34 between a raised configuration (see, e.g., FIGS. 1-2) and a lowered configuration (see, e.g., FIG. 3). For example, the first actuator 42 may be configured to actuate the lift member 44 to manipulate the height of the patient support deck 38 relative to the base 34, and the second actuator 46 may be configured to actuate the patient support deck 38 relative to the lift member 44 to maintain a level configuration of the patient support deck 38. Those having ordinary skill in the art will appreciate that the actuators 42, 46 can also be configured to "tilt" the patient support deck 38 relative to the base 34, such as to place the patient in a Trendelenburg position (not shown). The Applicant has described different types of rotary actuators and patient support apparatuses 30 which employ rotary actuators in U.S. Patent Application Publication No. 2018/0000673, filed on Jun. 28, 2017, entitled "Patient Support Systems with Rotary Actuators," the disclosure of which is hereby incorporated by reference.

While the lift mechanism illustrated in the Figures employs rotary actuators to facilitate movement of the patient support deck 38 relative to the base 34, it will be appreciated that different types of lift mechanisms and/or actuators could be utilized in certain embodiments. By way of non-limiting example, the lift mechanism could comprise one or more linear actuators, linkages, and the like which cooperate to move the patient support deck 38 relative to the base 34. Thus, the lift mechanism may take on any known or conventional design, and is not limited to those that are specifically illustrated, and may employ linear actuators, rotary actuators, and/or other types of actuators, each of which may be electrically operated, hydraulic, pneumatic or combinations thereof. The Applicant has described one type of lift mechanism which employs linear actuators in U.S. Patent Application Publication No. 2016/0302985, filed on Apr. 20, 2016, entitled "Patient Support Lift Assembly," the disclosure of which is hereby incorporated by reference. Other configurations and arrangements of the lift mechanism and/or actuators are contemplated.

The patient support deck 38 comprises several sections, some of which are capable of articulating (e.g., pivoting) relative to one another, such as a back section 41, a seat section 43, and a leg section 45. It is also contemplated that the various sections of the patient support deck 38 may be combined or conjoined. For example, the seat section 43 and the leg section may be conjoined, as shown in FIG. 4D (described in greater detail below). While not shown in the Figures, it is further contemplated that the leg section 45 of the patient support deck 38 may be divided into multiple sections, so as to comprise separate thigh and foot sections. The addition of the foot section may provide additional adjustment and/or configurations of the leg section 45 to provide the patient with needed support or comfort. The patient support deck 38 provides a patient support surface upon which the patient is supported.

A mattress 49 may be disposed on the patient support deck 38 during use. The mattress 49 comprises a secondary patient support surface upon which the patient is supported. The base 34, patient support deck 38, and mattress 49 each have a head end and a foot end corresponding to designated placement of the patient's head and feet on the patient support apparatus 30. The base 34 comprises a longitudinal axis L1 along its length from the head end to the foot end. The base 34 also comprises a vertical axis V arranged crosswise (e.g., perpendicularly) to the longitudinal axis L1 along which the patient support deck 38 is lifted and lowered relative to the base 34. The patient support deck 38 comprises a second longitudinal axis L2 along its length from the head end to the foot end. The construction of the support structure 32 may take on any known or conventional design, and is not limited to that specifically set forth above. In addition, the mattress 49 may be omitted in certain embodiments, such that the patient rests directly on the patient support surface or patient support deck 38.

The patient support apparatus 30 may also include a plurality of side rails 48, 50. Side rails 48, 50 may be coupled to the patient support deck 38 and are thereby supported by the base 34. A first side rail 48 is positioned at a left head end of the patient support deck 38. A second side rail 50 is positioned at a left foot end of the patient support deck 38. While not illustrated in the Figures, it should be understood that it is contemplated that the patient support apparatus 30 may include additional side rails. For example, the patient support apparatus 30 may include side rails, similar to those described above, on the right side of the patient support apparatus 30. If the patient support apparatus 30 is a stretcher or a cot, there may be fewer side rails. The side rails 48, 50 are movable between a raised position in which they block ingress and egress into and out of the patient support apparatus 30, one or more intermediate positions, and a lowered position in which they are not an obstacle to such ingress and egress. In still other configurations, the patient support apparatus 30 may not include any side rails.

While not illustrated in the Figures, it is contemplated that the patient support apparatus 30 may also include a headboard and/or a footboard that are coupled to the patient support deck 38. In other embodiments, when the headboard and footboard are included, the headboard and footboard may be coupled to other locations on the patient support apparatus 30, such as the base 34. While the patient support apparatus 30 illustrated throughout the drawings does not employ a headboard or a footboard, the Applicant has described patient support apparatuses 30 which do employ headboards, footboards, and side rails in U.S. Pat. No. 7,690,059, the disclosure of which is hereby incorporated by reference. In still other embodiments, the patient support apparatus 30 does not include the headboard and/or the footboard.

Caregiver interfaces 56, such as handles, are shown integrated into the side rails 48, 50 to facilitate movement of the patient support apparatus 30 over floor surfaces. Additional caregiver interfaces 56 may be integrated into the headboard, footboard, and/or other components of the patient support apparatus 30. The caregiver interfaces 56 are graspable by the caregiver to manipulate the patient support apparatus 30 for movement.

Other forms of the caregiver interface 56 are also contemplated. The caregiver interface 56 may comprise one or more handles coupled to the patient support deck 38. The caregiver interface 56 may simply be a surface on the patient support apparatus 30 upon which the caregiver logically applies force to cause movement of the patient support apparatus 30 in one or more directions, also referred to as a push location. The caregiver interface 56 may positioned at any suitable location of the patient support apparatus 30 to aid the caregiver in manipulating the patient support apparatus 30. This may comprise one or more surfaces on the patient support deck 38 or base 34. This could also comprise one or more surfaces on or adjacent to the headboard, footboard, and/or side rails 48, 50. In other embodiments, the caregiver interface 56 may comprise separate handles for each hand of the caregiver. For example, the caregiver interface may comprise two handles.

Wheels 58 are coupled to the base 34 to facilitate transport over the floor surfaces. The wheels 58 are arranged in each of four quadrants of the base 34 adjacent to corners of the base 34. In the embodiment shown, the wheels 58 are caster wheels able to rotate and swivel relative to the support structure 32 during transport. Each of the wheels 58 forms part of a caster assembly 60. Each caster assembly 60 is mounted to the base 34. It should be understood that various configurations of the caster assemblies 60 are contemplated. In addition, in some embodiments, the wheels 58 are not caster wheels and may be non-steerable, steerable, non-powered, powered, or combinations thereof. Additional wheels are also contemplated. For example, the patient support apparatus 30 may comprise four non-powered, non-steerable wheels, along with one or more powered wheels. In some cases, the patient support apparatus 30 may not include any wheels.

In other embodiments, one or more auxiliary wheels (powered or non-powered), which are movable between stowed positions and deployed positions, may be coupled to the support structure 32. In some cases, when these auxiliary wheels are located between caster assemblies 60 and contact the floor surface in the deployed position, they cause two of the caster assemblies 60 to be lifted off the floor surface thereby shortening a wheel base of the patient support apparatus 30. A fifth wheel may also be arranged substantially in a center of the base 34.

Referring to FIG. 1, an illustration of the patient support deck 38 in a bed configuration is shown. In particular, the deck sections 41, 43, 45 are shown generally flat or co-planar. More specifically, the back section 41, seat section 43, and leg section 45 are in a lowered or flat and co-planar configuration along the longitudinal axis L2 the patient support deck 38.

The deck sections 41, 43, 45 are pivotally coupled together in series at pivot joints defined about one or more pivot axes, for example P1 and P2. Each of the deck sections 41, 43, 45 have a first end and a second end. The first end is closer to the head end of the patient support apparatus 30 when the patient support deck 38 is in a flat configuration and the second end is closer to the foot end of the patient support apparatus 30 when the patient support deck 38 is in the flat configuration. In the embodiment shown, the second end of the back section 41 is pivotally coupled to the first end of the seat section 43 about pivot axis P1. The first end of the leg section 45 is pivotally coupled to the second end of the seat section 43 about pivot axis P2.

The deck sections 41, 43, 45 may be pivotally coupled together by pivot pins, shafts, hinges, and the like at the pivot joints. Pivot brackets may be employed to form the pivot joints. Additionally, other types of connections are possible between the deck sections 41, 43, 45 so that the deck sections 41, 43, 45 are capable of moving, e.g., articulating, relative to one another. For instance, in some cases, translational joints may be provided between adjacent deck sections, or other compound movement connections may be provided between adjacent deck sections, such as joints that allow both pivotal and translational motion between adjacent deck sections.

Figure 4A:
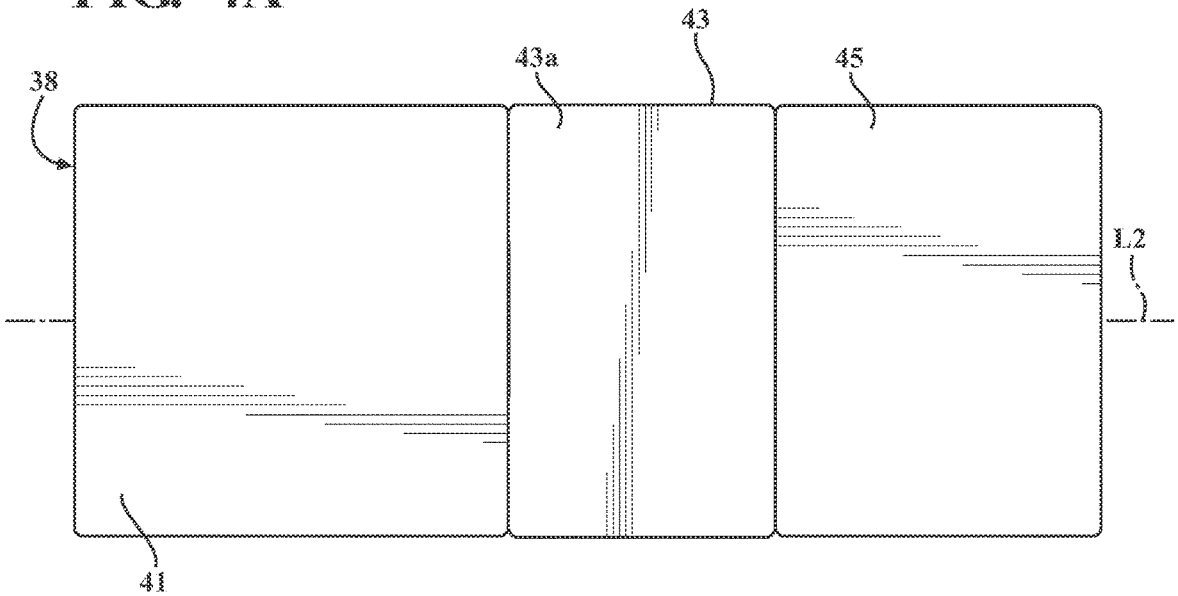
FIG. 4A is a top view of a patient support deck comprising a single seat.
Figure 4B:
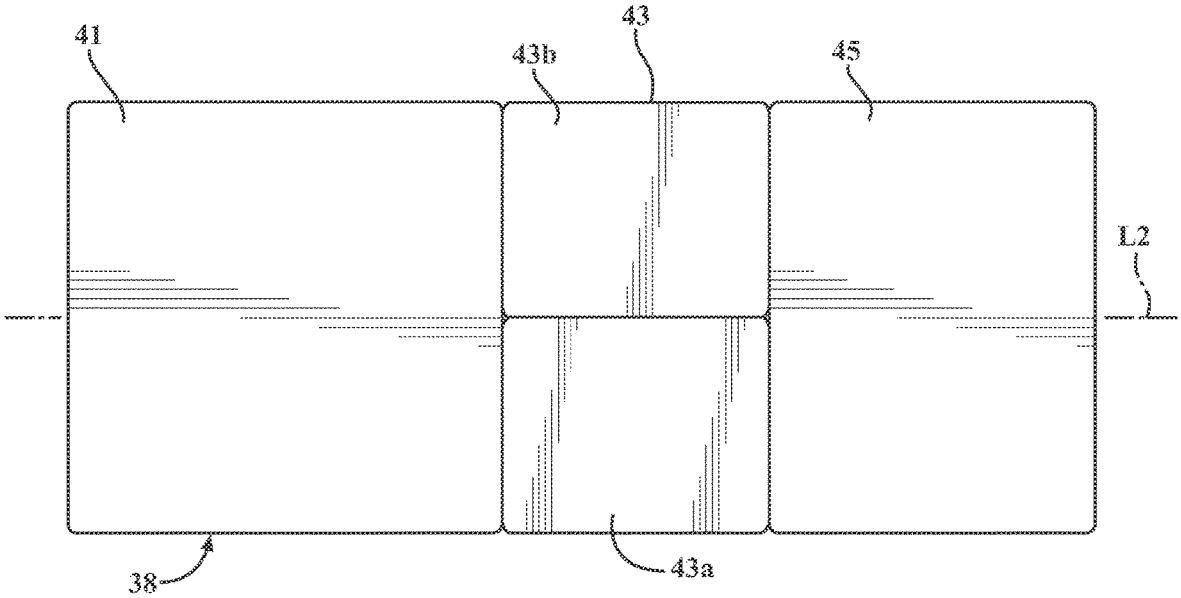
FIG. 4B is a top view of an alternative embodiment of the patient support deck comprising two seats.
Figure 4C:
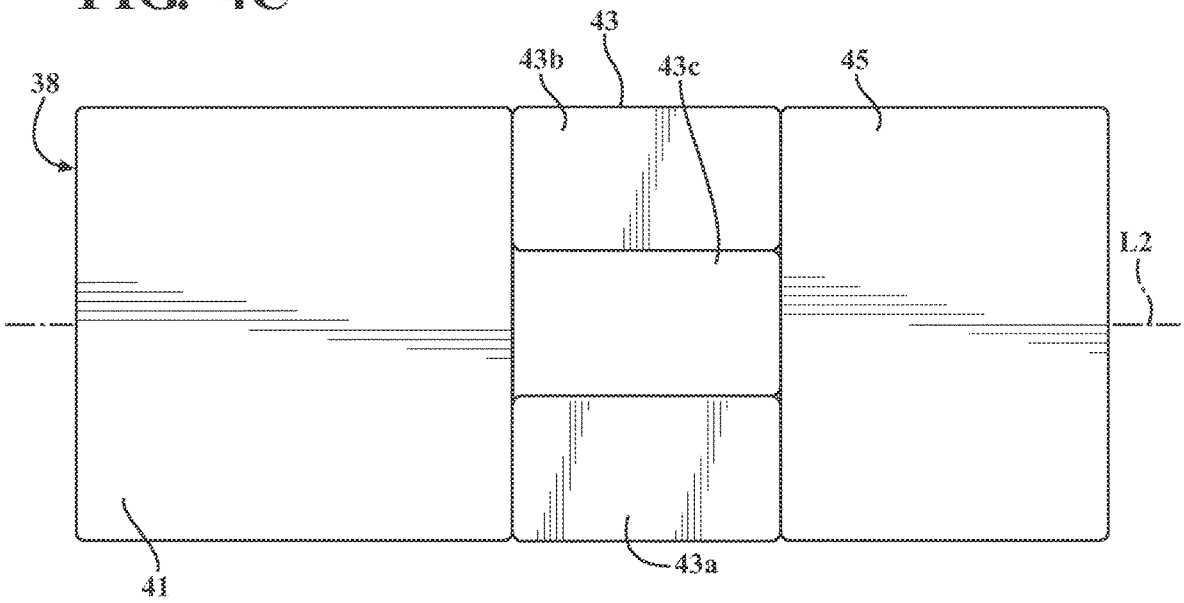
FIG. 4C is a top view of an alternative embodiment of the patient support deck comprising three seats.
Figure 4D:
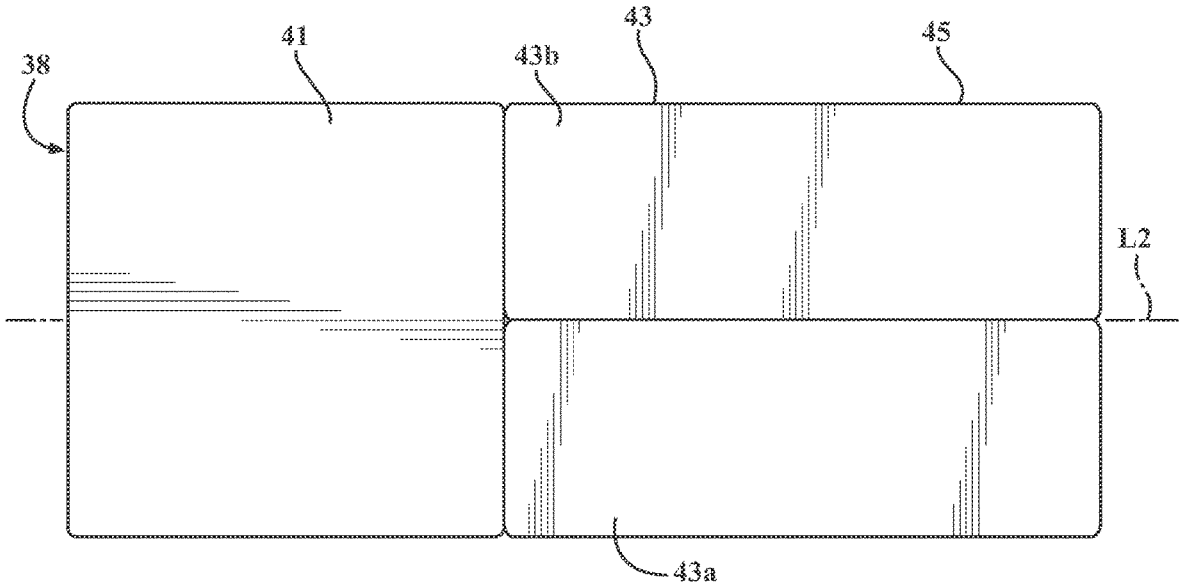
FIG. 4D is a top view of an alternative embodiment of the patient support deck comprising two seats with a conjoined seat section and leg section.

Referring to FIGS. 4A-4C, exemplary embodiments of the patient support deck 38 and corresponding deck sections 41, 43, 45 are shown. The seat section 43 may include one or more seats that may be articulated relative to one another. The seat(s) may be articulated to facilitate patient egress and/or ingress from the patient support apparatus 30. For example, FIG. 4A illustrates an exemplary patient support deck 38 wherein the seat section 43 includes a first seat 43*a*. The entire first seat, as illustrated in FIG. 4A, may be configured to pivot or articulate about the longitudinal axis L2 of the support deck 38 relative to the support frame 36. Alternatively, FIGS. 4B and 4C, illustrate an exemplary patient support deck 38 wherein the seat section 43 includes a plurality of seats. For example, FIG. 4B illustrates an exemplary patient support deck 38 comprising a first seat 43*a* and a second seat 43*b*. FIG. 4C illustrates an exemplary patient support deck 38 comprising a first seat 43*a*, a second seat 43*b*, and a third seat 43*c*. In both embodiments including a plurality of seats (FIGS. 4B and 4C), the first 43*a* and/or second seat 43*b* may be configured to articulate relative to the other to transition from a bed configuration to an egress configuration (can also be referred to as an ingress configuration), and vice versa. For example, the first seat 43*a* may be pivoted or articulated about the longitudinal axis L2 of the patient support deck 38 relative to the support frame 36, wherein an outer edge of the first seat 43*a* moves in a generally downward direction to allow a patient to more easily exit/enter the patient support apparatus 30 (see, e.g., FIG. 13). The second seat 43*b* may be stationary, or the second seat 43*b* may be configured to pivot or articulate about the longitudinal axis L2 of the support deck 38 relative to the support frame 36, wherein an outer edge of the second seat moves in a generally upward direction to provide support and prevent a patient from falling backward when exiting the patient support apparatus 30. The first and second seats 43*a*, 43*b* may also pivot about other longitudinal axes parallel to the longitudinal axis L2 of the patient support deck 38, or may move in other ways to provide the egress configuration.

Similarly, in the seat section 43 illustrated in FIG. 4C, the first 43*a* and second seats 43*b* may be pivotable or otherwise articulable as described above relative to the third seat 43*c*. In this embodiment, the third seat 43*c* may remain stationary or flat to support the patient. The third seat section may also be configured to be raised and lowered to assist patient ingress and egress (see, e.g., FIG. 10). For example, the third seat 43*c* may be raised to boost the patient during egress to help them stand. Alternatively, the third seat 43*c* may be lowered to receive the patient during ingress. The seats 43*a*, 43*b*, 43*c* may comprise deck panels similar to the back section 41 and the leg section 45, may comprise frame members, or any other structure suitable to carry out the ingress and/or egress functions described herein. While not shown in the figures, it is contemplated that the seat section 43 may comprise more than three seats, wherein the various seats may be configured to articulate and/or remain stationary.

Referring to FIG. 4D, an alternative exemplary embodiment of the patient support deck 38 comprises a conjoined seat section and leg section 45. Similar to those described above, the seat section 43 may comprise one or more seats 43*a*, 43*b* . . . 43*n*. The seats 43*a* and 43*b*, as illustrated in FIG. 4D, may be configured to articulate relative to the other to transition from a bed configuration to an egress configuration (can also be referred to as an ingress configuration), and vice versa. For example, the first seat 43*a* may be pivoted or articulated about the longitudinal axis L2 of the patient support deck 38 relative to the support frame 36, wherein an outer edge of the first seat 43*a* moves in a generally downward direction to allow a patient to more easily exit/enter the patient support apparatus 30 (see, e.g., FIG. 13). The second seat 43*b* may be stationary, or the second seat 43*b* may be configured to pivot or articulate about the longitudinal axis L2 of the support deck 38 relative to the support frame 36, wherein an outer edge of the second seat moves in a generally upward direction to provide support and prevent a patient from falling backward when exiting the patient support apparatus 30. The first and second seats 43*a*, 43*b* may also pivot about other longitudinal axes parallel to the longitudinal axis L2 of the patient support deck 38, or may move in other ways to provide the egress configuration.

Figure 5:
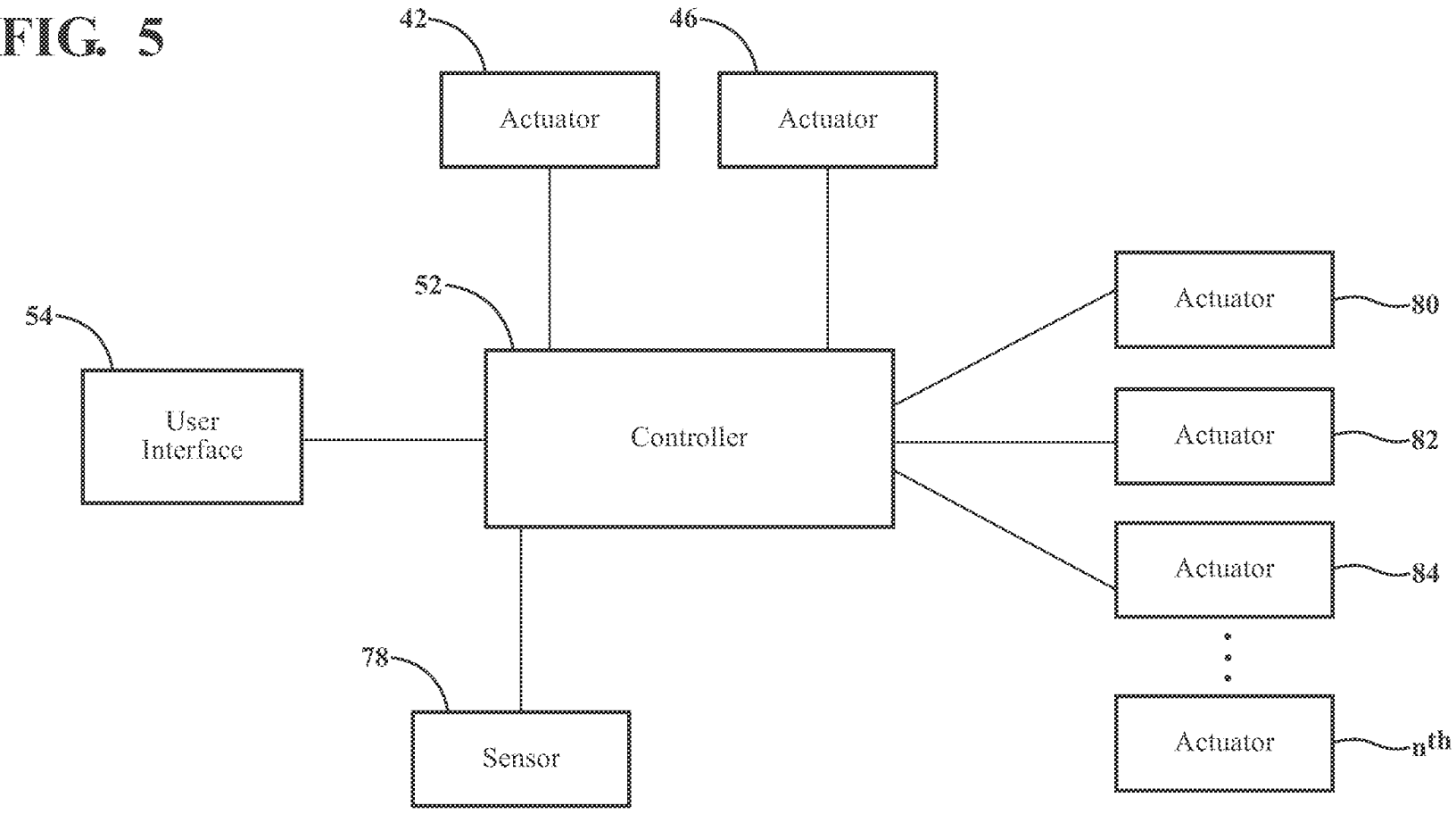
FIG. 5 is a schematic diagram of an example controller and peripheral devices.
Figure 6:
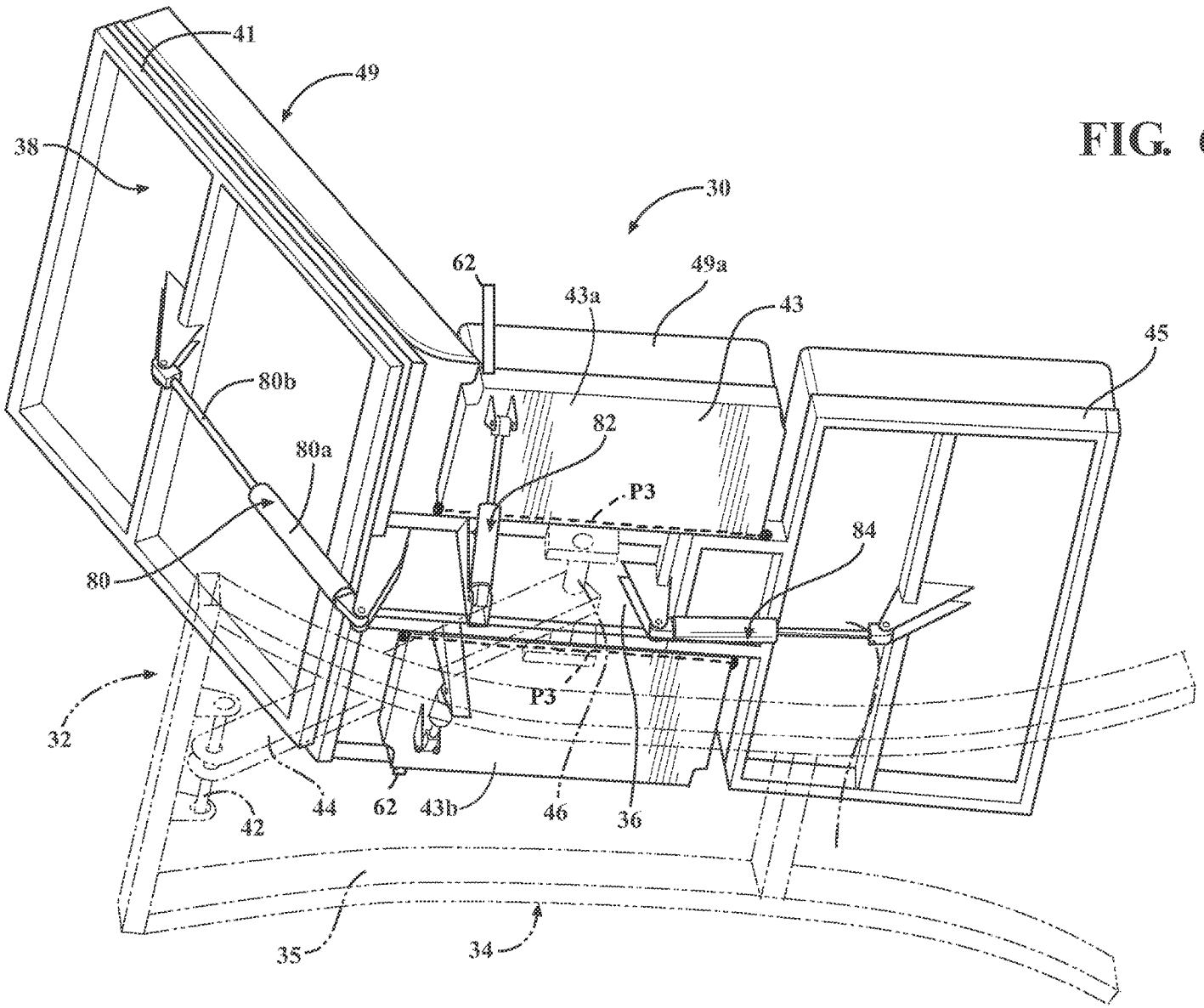
FIG. 6 is a perspective view of the bottom of the patient support apparatus.
Figure 7:
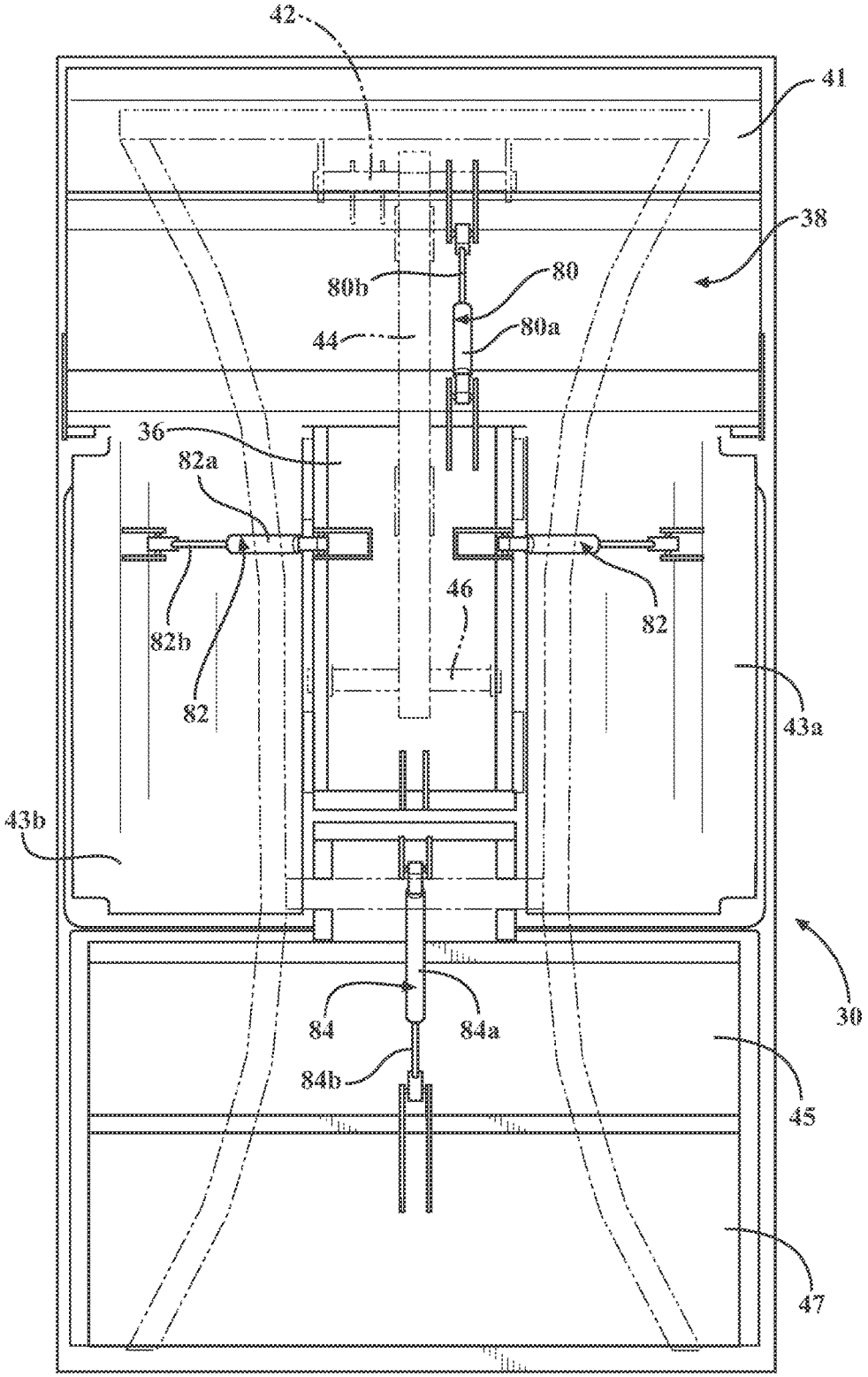
FIG. 7 is a bottom view of the patient support apparatus of FIG. 6.

Referring to FIGS. 5 through 7, the patient support apparatus 30 comprises an actuator system comprising a plurality of actuators 80, 82, 84 interconnected with the various sections of the patient support deck 38. The actuators 80, 82, 84 may be configured to articulate the various sections of the patient support deck 38. For example, the actuators 80, 82, 84 operate to move the back section 41, seat section 43, and leg section 45. The actuators 80, 82, 84 may be linear actuators, rotary actuators, or other type of actuators capable of moving the back section 41, seat section 43, and leg section 45. The actuators 80, 82, 84 may be electrically powered, hydraulic, electro-hydraulic, pneumatic, or the like. In the embodiment shown, the actuators 80, 82, 84 are electrically powered linear actuators comprising actuator housings 80*a*, 82*a*, 84*a* and drive rods 80*b*, 82*b*, 84*b* that extend and retract with respect to their associated actuator housing 80*a*, 82*a*, 84*a*. Hereinafter, the actuators 80, 82, 84 shall be referred to as back section actuator 80, seat section actuator(s) 82, and leg section actuator 84.

The back section actuator 80 is operatively connected to the back section 41 and the support frame 36. The back section actuator 80 may be configured to pivot, or otherwise articulate, the back section 41 relative to the support frame 36 between a lowered position and one or more raised positions. More specifically, the back section actuator 80 pivots the back section 41 about the pivot axis P1 relative to the seat section 43. In the embodiment shown, the back section actuator 80 is pivotally connected at a first actuator end to a mounting bracket fixed to the support frame 36. The back section actuator 80 is pivotally connected at a second actuator end to a mounting bracket fixed to the back section 41. The back section actuator 80 could be pivotally connected to these brackets via pivot pins, shafts, and the like. In other embodiments, the back section actuator 80 may be connected through other types of connections or linkages in order to move the back section 41 to the lowered position or the one or more raised positions. For example, the back section actuator 80 may operate in a similar manner to that shown in U.S. Patent Application Publication No. 2017/0281438, filed on Mar. 30, 2017, entitled, "Patient Support Apparatus with Adjustable Foot Section," which is hereby incorporated herein by reference.

The seat section actuators 82 are operatively connected to the seat section 43 to pivot, or otherwise articulate, the plurality of seats 43*a*, 43*b*, 43*c* about pivot axes relative to one another to transition the seat section 43 from the bed configuration to the egress configuration. The seats 43*a*, 43*b*, 43*c* may be pivoted or articulated along one or more longitudinal axes of the patient support apparatus 30 to transition from the bed configuration to the egress configuration, and vice versa. The seat section actuator(s) 82 may be operatively connected between the support frame 36 and the seats 43*a*, 43*b*, and be configured to articulate the seats 43*a*, 43*b* when transitioning between the bed and egress configuration. In the embodiment shown in FIGS. 6 and 7, which shows the version of seats 43*a*, 43*b*, 43*c* from FIG. 4C, each of the seat section actuators 82 are pivotally connected at a first actuator end to a mounting bracket fixed to the support frame 36 (separate mounting brackets are shown for each actuator 82, but the same mounting bracket could be employed). Each of the seat section actuators 82 are pivotally connected at a second actuator end to a mounting bracket fixed to the respective seats 43*a*, 43*b* to pivot the seats 43*a*, 43*b* about pivot axes P3, which are parallel to the longitudinal axis L2. The seat section actuators 82 could be pivotally connected to these brackets via pivot pins, shafts, and the like. In other embodiments, the seat section actuators 82 may be connected through other types of connections or linkages in order to move the seats 43*a*, 43*b*, 43*c* in the manner described herein. Two or more seats 43*a*, 43*b*, 43*c* may be articulated in a coordinated, sequential, simultaneous, synchronized, and/or independent movement. A number of possible articulation patterns and/or movement configurations for the seats 43*a*, 43*b*, 43*c* are contemplated.

The leg section actuator 84 is operatively connected to the leg section 45 to pivot, or otherwise articulate, the leg section 45 relative to the support frame 36 between a lowered position and one or more raised positions. More specifically, the leg section actuator 84 may pivot the leg section 45 about the pivot axis P2 relative to the seat section 43. In an embodiment where the leg section 45 includes an additional foot section, the pivotal coupling of the leg section 45 to the foot section may cause the foot section to articulate when the leg section 45 is moved. In the embodiment shown, the leg section actuator 84 is pivotally connected at a first actuator end to a mounting bracket fixed to the support frame 36. The leg section actuator 84 is pivotally connected at a second actuator end to a mounting bracket fixed to the leg section 45. The leg section actuator 84 could be pivotally connected to these brackets via pivot pins, shafts, and the like. In other embodiments, the leg section actuator 84 may be connected through other types of connections or linkages in order to move the leg section 45 to the lowered position or the one or more raised positions. For example, the leg section actuator 84 may operate in a similar manner to that shown in U.S. Patent Application Publication No. 2017/0281438, filed on Mar. 30, 2017, entitled, "Patient Support Apparatus with Adjustable Foot Section," which is hereby incorporated herein by reference.

Referring to FIG. 5, the patient support apparatus 30 comprises a controller 52 coupled to the actuator system. The controller 52 may be coupled to and configured to operate and control the plurality of actuators 42, 46, 80, 82, 84 of the actuator system to manipulate and/or articulate the patient support deck 38. As discussed above, the seats 43*a*, 43*b*, 43*c* may be articulated in a coordinated, sequential, simultaneous, synchronized, and/or independent motion. The controller 52 may be configured to execute the articulation of the seats 43*a*, 43*b*, 43*c* in the coordinated, sequential, simultaneous, synchronized, and/or independent motion. For example, the controller 52 may be configured to articulate the seats 43*a*, 43*b* independently or sequentially, wherein the second seat 43*b* may be rotated up first to provide the patient with back support, then the first seat 43*a* may be rotated down to allow the patient to exit. Alternatively, the first seat 43*a* and second seat 43*b* may be articulated simultaneously or in a coordinated motion. Furthermore, the second seat 43*b* may be rotated up, then the first seat 43*a* may be lowered as the patient support deck 38 is raised to boost the patient out of the patient support apparatus 30. While not described in detail, the controller 52 may be configured to articulate the seats 43*a*, 43*b*, 43*c* of the seat section 43 in any number of coordinated, sequential, independent, and/or simultaneous movements to transition the seat section 43 from the bed configuration to the egress configuration, and vice versa. Similarly, the controller 52 may be configured to actuate the back section actuator 80 and/or the leg section actuator 84 to articulate the back section 41 and/or the leg section 45, respectively. The controller 52 may also be configured to articulate the lift mechanism actuator(s) 42, 46 to manipulate the height and or orientation of the patient support deck 38.

A user interface 54 is coupled to the controller 52. The user interface 54 may include a plurality of buttons, switches, or the like configured to receive a user input. The user may enter an input or instruction into the user interface 54 to manipulate the patient support apparatus 30. For example, user may raise or lower the patient support deck 38 by pressing a button on the user interface 54. In one version, handles 62 may form part of the user interface 54, as shown in FIG. 6, so that when one of the handles 62 is manipulated it causes the controller 52 to operate an associated actuator 82, as described further below. The controller 52 may be configured to receive the user input from the user interface 54 and engage the actuator system to manipulate or articulate the patient support apparatus 30. For example, the patient may input a command to the user interface 54 via one or more buttons to raise or lower the patient support deck 38, articulate the first 43*a* and second seats 43*b*, and/or any of the other sections of the support deck 41, 43, 45. In some versions, one button, for example, may be actuated by a user to move the second seat 43*b* relative to the first seat 43*a* (or vice versa) to transition the seat section 43 from the bed configuration to the side-egress configuration and another button may be actuated by the user to move the second seat 43*b* relative to the first seat 43*a* (or vice versa) to transition the seat section 43 from the side-egress configuration to the bed configuration.

Figure 8:
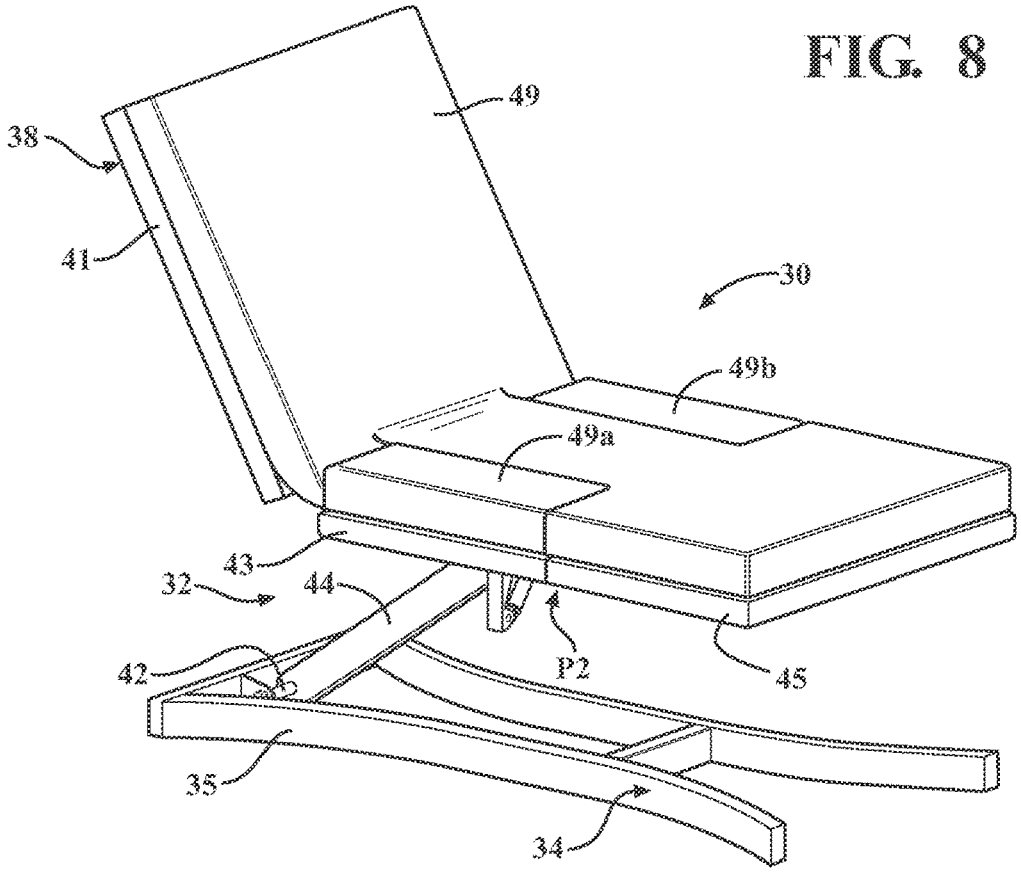
FIG. 8 is a perspective view of the patient support apparatus of FIG. 6.
Figure 9:
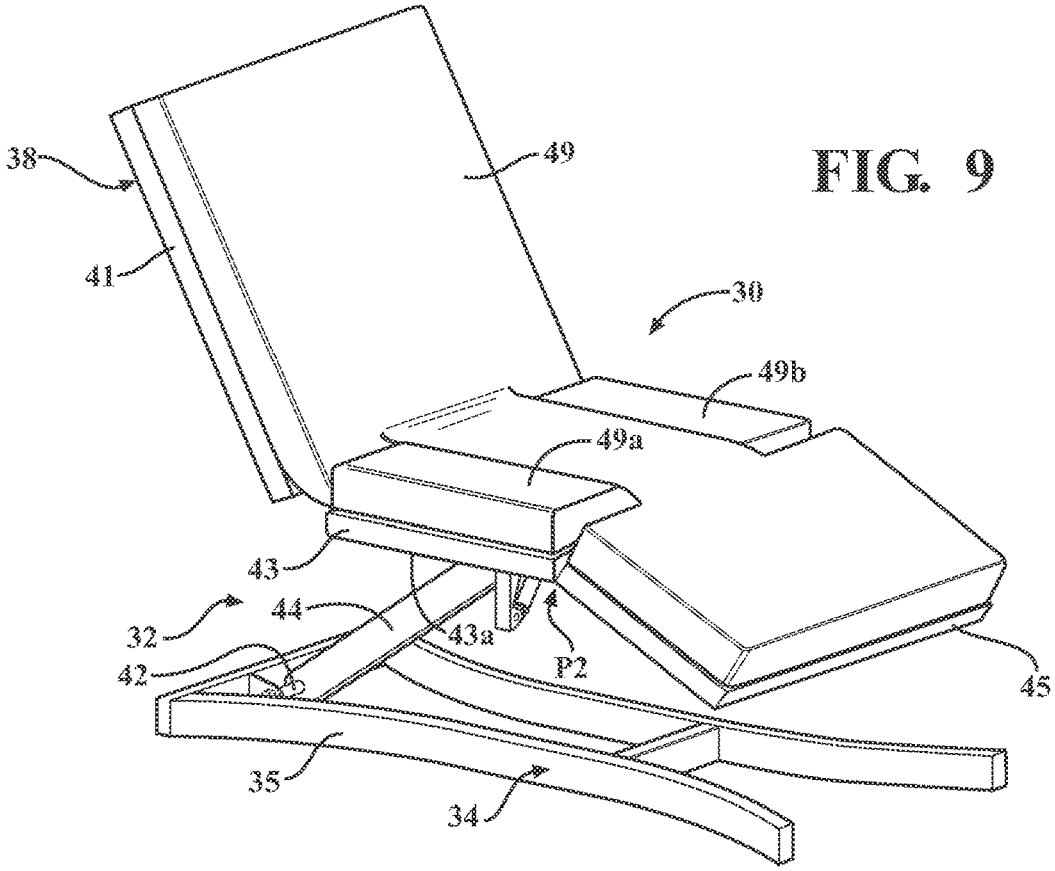
FIG. 9 is a perspective view of the patient support apparatus of FIG. 6.
Figure 10:
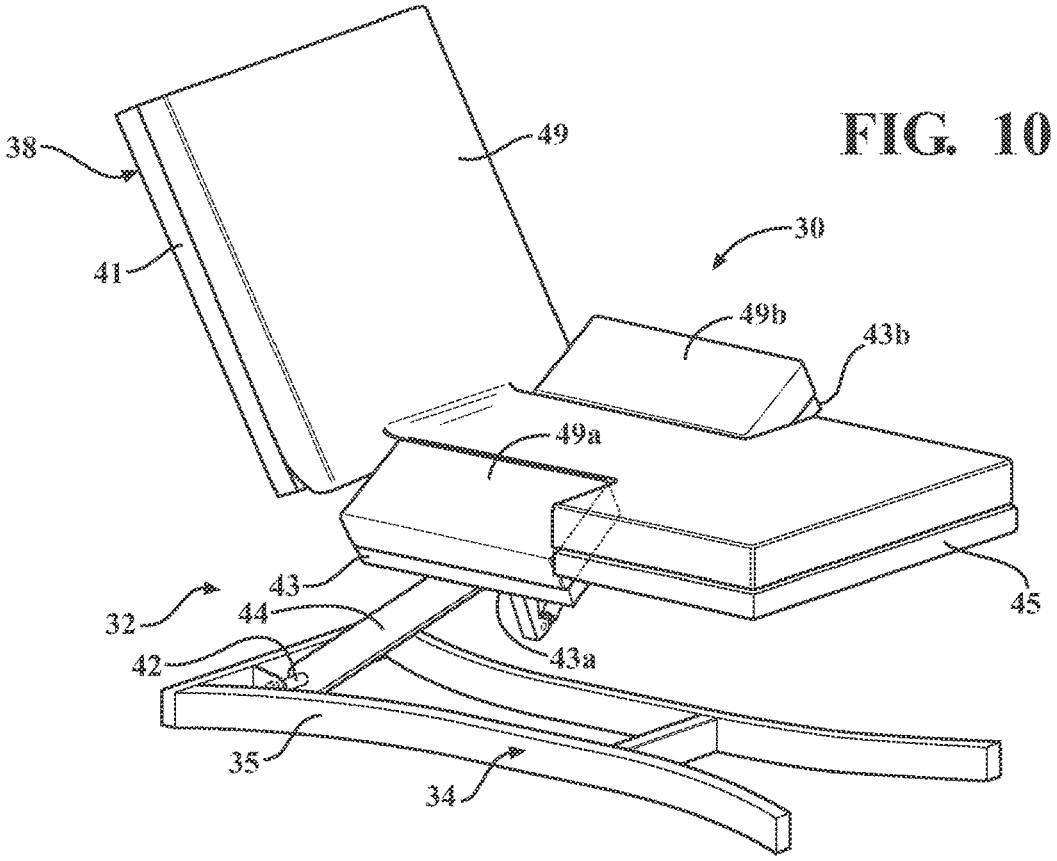
FIG. 10 is a perspective view of the patient support apparatus of FIG. 6.

Referring to FIGS. 8-10, the patient support apparatus 30 including a seat section 43 with a three seat configuration is shown. The patient support apparatus 30 includes the mattress 49 including a first seat mattress 49*a* positioned atop the first seat 43*a* and a second seat mattress 49*b* positioned atop the second seat 43*b*. The first mattress seat 49*a* and second mattress seat 49*b* may follow, mimic, and/or translate with the articulation of the first seat 43*a* and second seat 43*b* respectively. FIG. 8 illustrates an example configuration of the patient support apparatus 30 with the back section 41 elevated. FIG. 9 illustrates an example configuration of the patient support apparatus 30 with the back section 41 elevated and the leg section 45 lowered or in a declined configuration. FIG. 10 illustrates an example configuration of the patient support apparatus 30 with the back section 41 elevated and the first seat 43*a* and second seat 43*b* articulated to the egress configuration. When the patient support apparatus 30 is transitioned from the bed configuration to the egress configuration, the lift mechanism may be manipulated to raise or lower the patient support deck 38 to assist with ingress and/or egress from the patient support apparatus 30. Furthermore, the third seat 43*c*, located between the first seat 43*a* and the second seat 43*b* may be raised or lowered to assist the patient with ingress and/or egress from the patient support apparatus 30. In the embodiment shown, the third seat 43*c* is fixed to the support frame 36 to move with the support frame 36 during raising and lowering via the lift mechanism.

Figure 11:
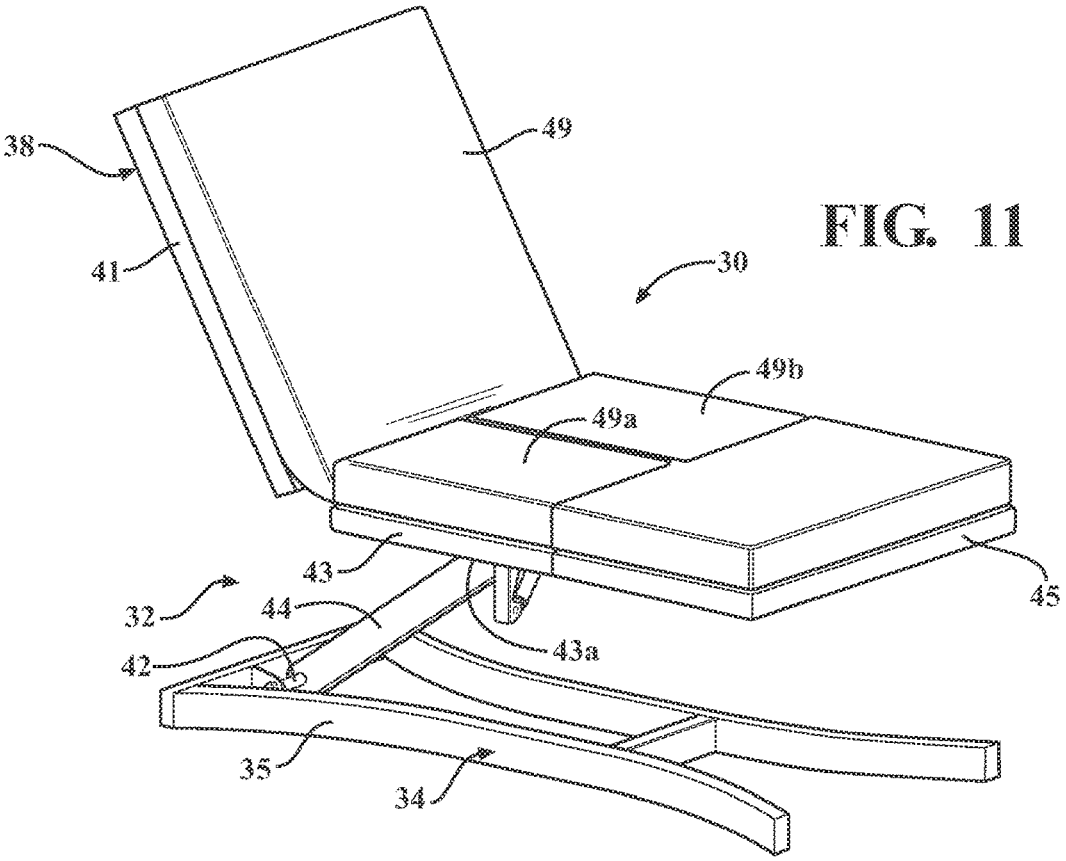
FIG. 11 is a perspective view of an alternative embodiment of the patient support apparatus of FIG. 6.
Figure 12:
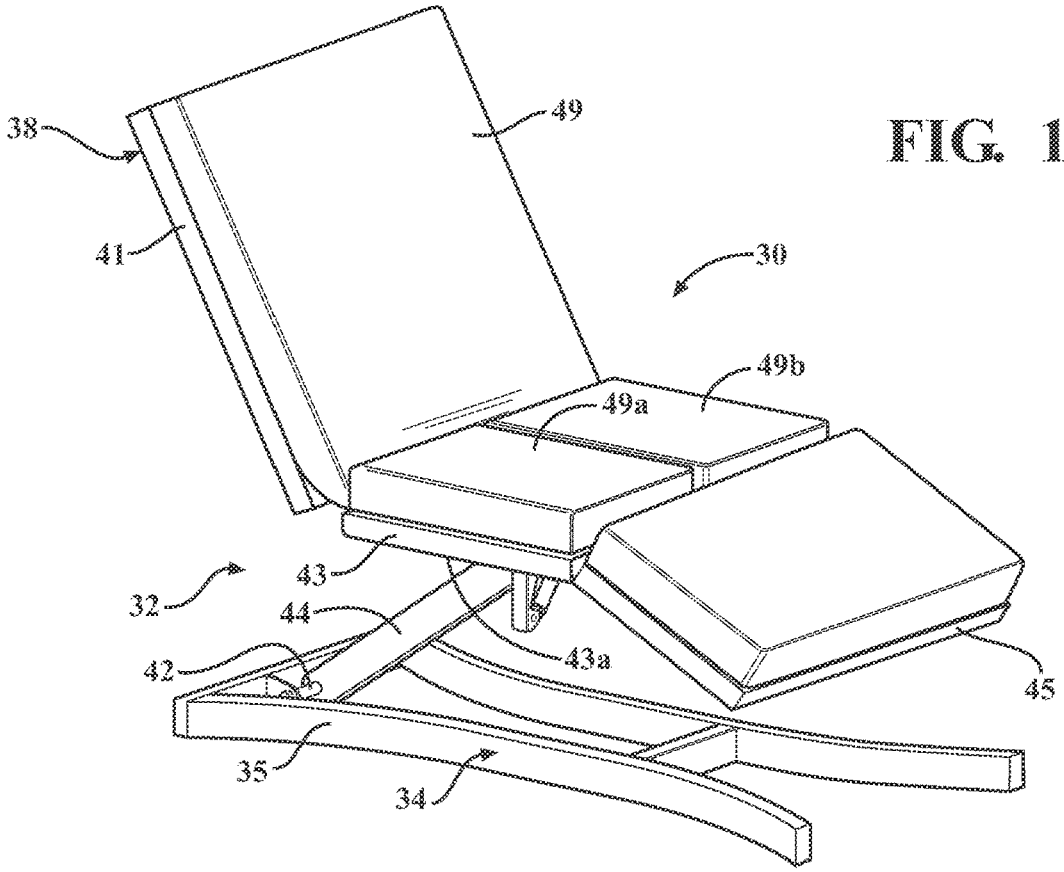
FIG. 12 is a perspective view of the patient support apparatus of FIG. 11.
Figure 13:
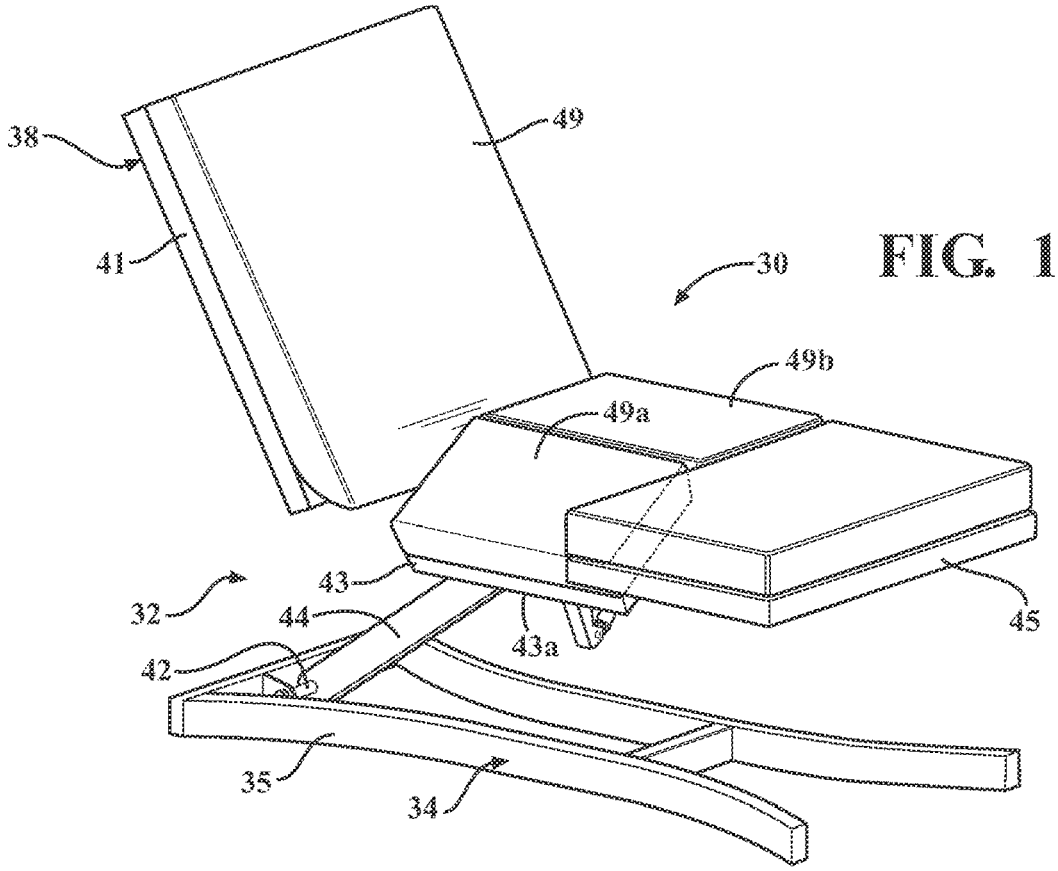
FIG. 13 is a perspective view of the patient support apparatus of FIG. 11.
Figure 14:
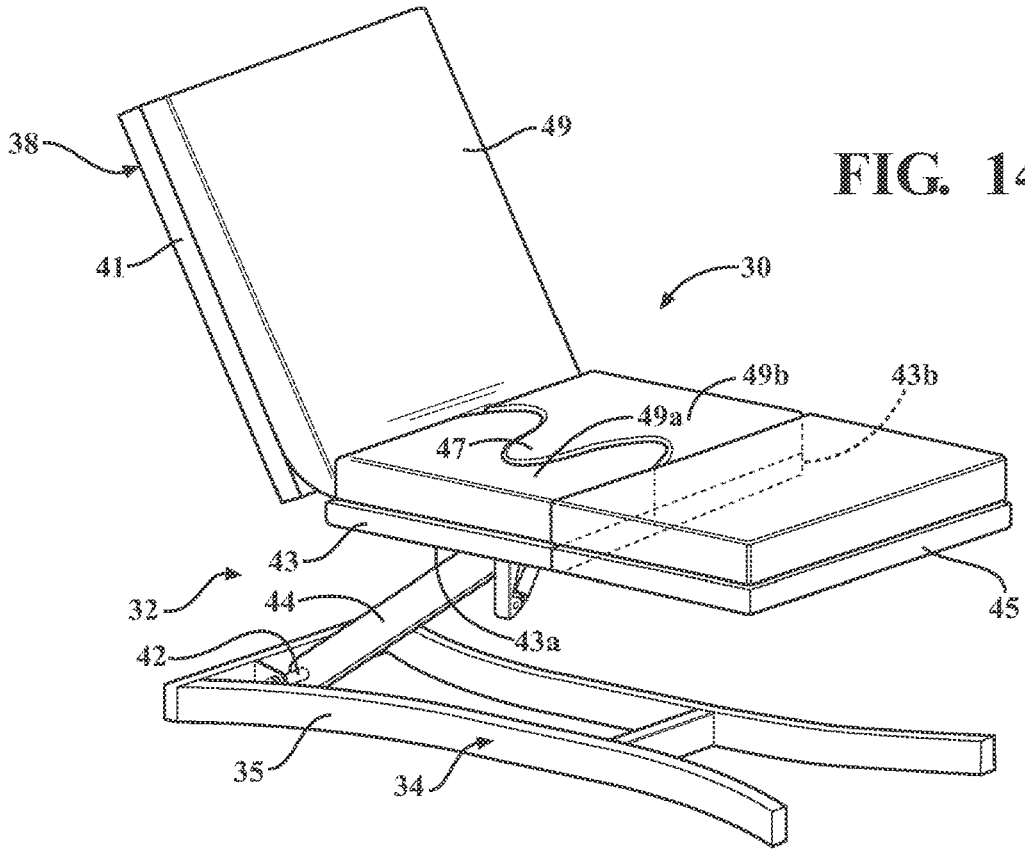
FIG. 14 is a perspective view of an alternative embodiment of the patient support apparatus of FIG. 11.
Figure 15:
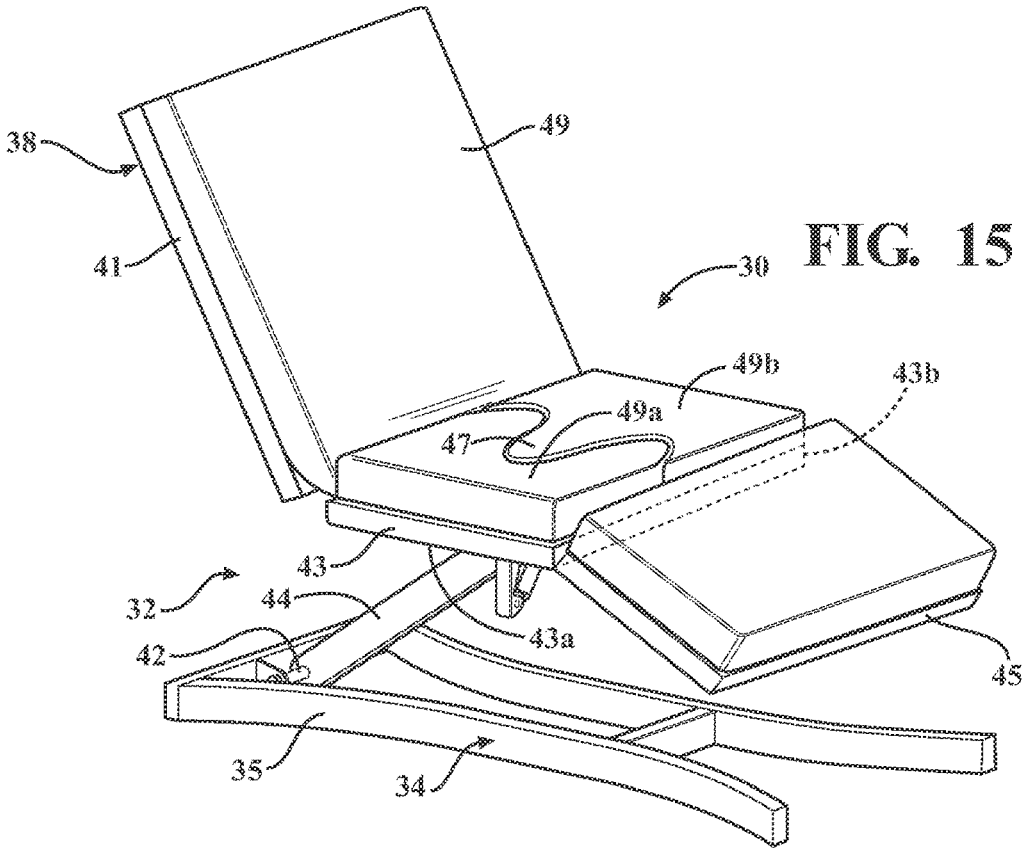
FIG. 15 is a perspective view of the patient support apparatus of FIG. 14.

Referring to FIGS. 11-18, the patient support apparatus 30 including the seat section 43 with a two seat configuration 43*a*, 43*b* is shown. The patient support apparatus includes the mattress 49 including a first seat mattress 49*a* positioned atop the first seat 43*a* and a second seat mattress 49*b* positioned atop the second seat 43*b*. The first mattress seat 49*a* and second mattress seat 49*b* may follow, mimic, and/or translate with the articulation of the first seat 43*a* and second seat 43*b* respectively. FIG. 11 illustrates an example patient support apparatus 30 with the back section 41 in an elevated position. FIG. 12 illustrates an example patient support apparatus 30 with the back section 41 in an elevated position and the leg section 45 lowered or in a declined position. FIG. 13 illustrates an example configuration of the patient support apparatus 30 with the back section 41 in an elevated position and the first seat 43*a* articulated to an example egress configuration. In other embodiments, the second seat 43*b* may also be articulated up when in the egress configuration.

The seat section 43 of the patient support apparatus 30 may also be configured to include mating features that create a saddle that supports the patient when the patient support apparatus 30 is in the egress configuration, as illustrated in FIGS. 14-18. For example, the second seat 43*b* may include a protrusion 47 configured to matingly engage a recess of the first seat 43*a*. The mating features create a saddle configured to fit between the patient's lower limbs or extremities, and support the patient as they exit and/or enter the patient support apparatus 30. The saddle shape may be included in the first seat 43*a* and/or the second seat 43*b*. The saddle is shown only in the first seat 43*a* for illustration, but could be similarly included for assisting ingress and/or egress from the other side of the patient support apparatus 30. The saddle shape may be formed in the seat 43*a*, 43*b* and/or the seat mattress 49*a*, 49*b*. While not shown in the Figures, it should be understood that alternative shapes, designs, and/or configurations of the mattress 49 and/or seat section 43 are contemplated.

Figure 16:
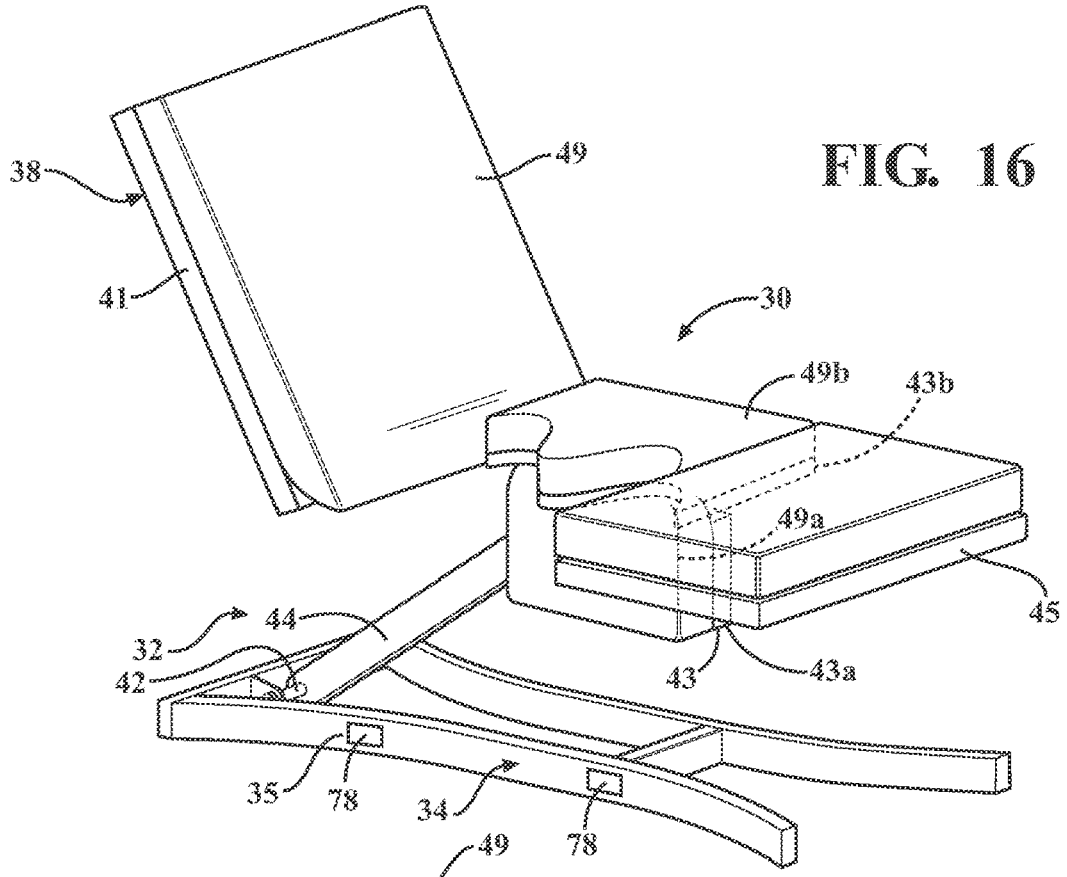
FIG. 16 is a perspective view of the patient support apparatus of FIG. 14.
Figure 17:
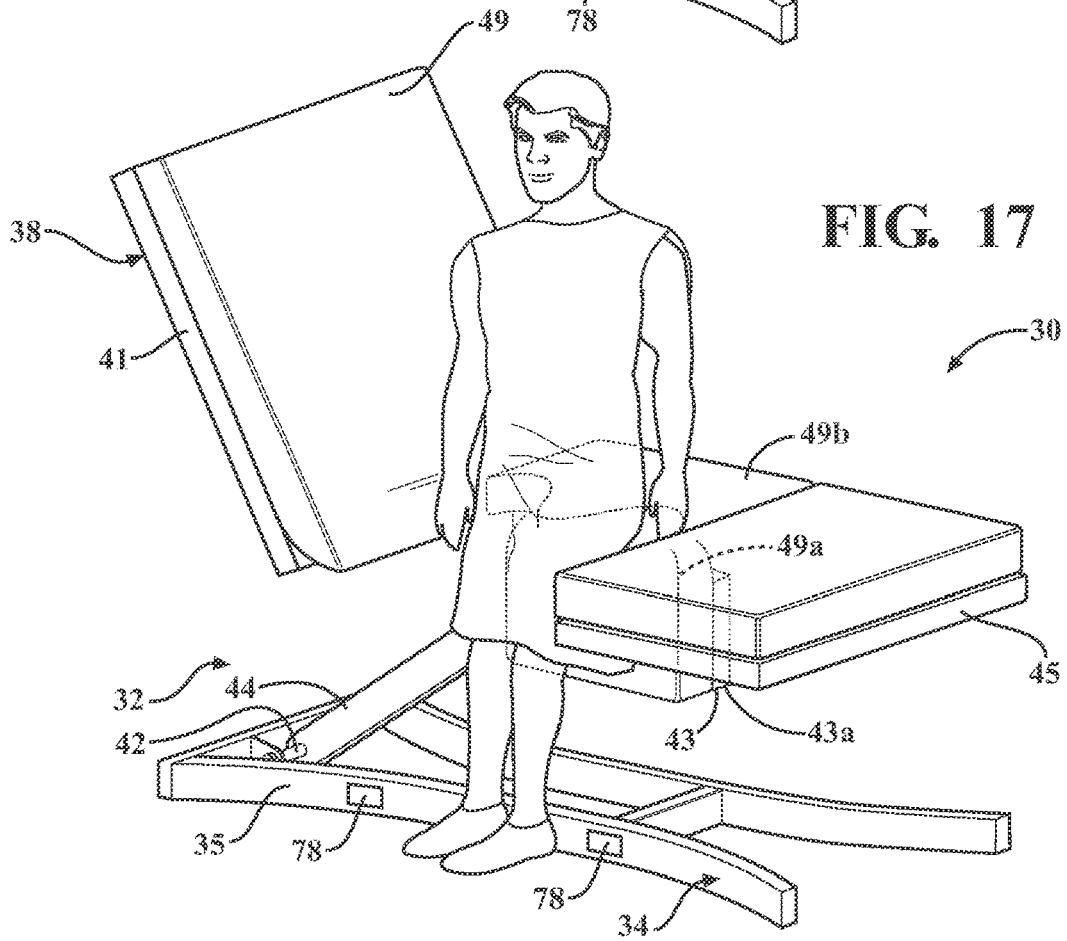
FIG. 17 is a perspective view of the patient support apparatus of FIG. 14 including a patient on the patient support apparatus.
Figure 18:
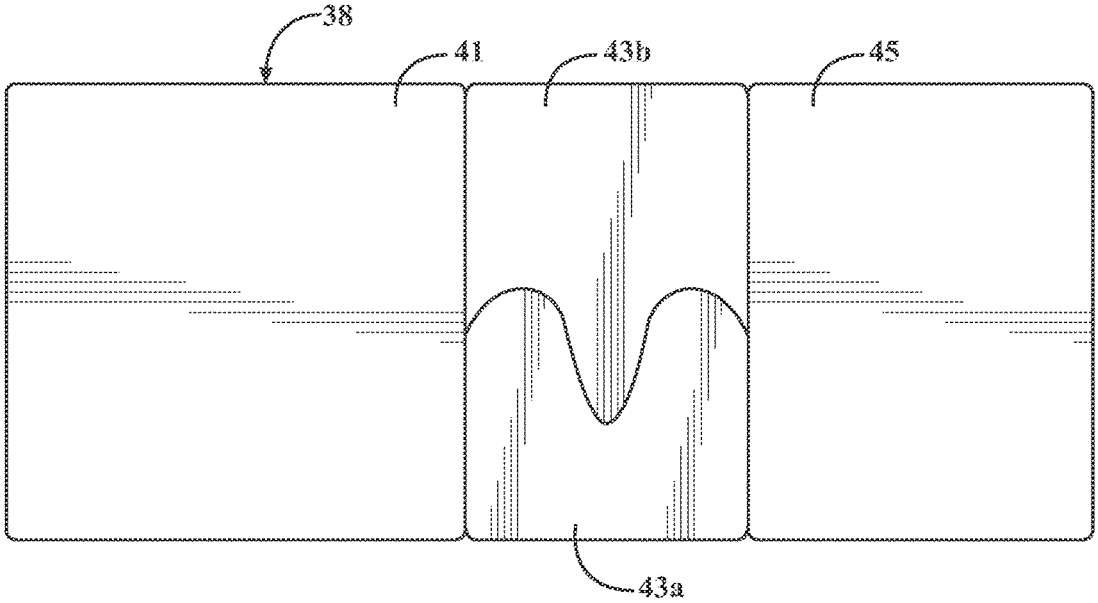
FIG. 18 is a top view of the patient support apparatus of FIG. 14.

The patient support apparatus 30 may also incorporate one or more sensors 78 configured to detect the presence of a patient, as illustrated in FIGS. 16 and 17. The patient support apparatus 30 may comprise one or more sensors 78 mounted proximate the support base 34, support deck 38, or the mattress 49. For example, the patient support apparatus 30 may comprise sensor 78 including a load cell, weight sensor, pressure sensor, optical sensor, infrared sensor, or motion sensor 78. The sensor 78 may be coupled to the controller 52. The controller 52 may be configured to operate patient support apparatus 30, and/or more specifically, the seat 43*a* based on the detection of the patient by the sensor 78. For example, an optical or infrared sensor may be mounted to the base 34 proximate the floor and configured to detect when a patient's feet or lower extremity touch the floor or support surface. In operation, if the sensor 78 fails to detect the patient's feet on the floor, suggesting the patient does not have their feet on the floor, the controller 52 may prevent the seat 43*a* from articulating until the patient is detected by the sensor 78. Similarly, if the sensor 78 does not detect the patient's feet on the floor, the controller 52 may lower the patient support apparatus 30 until the patient's feet are detected by the sensor 78 on the floor, before proceeding with articulation of the seat 43*a*. Alternatively, a load or pressure sensor may be mounted proximate the seat section 43 or mattress and configured to detect a decrease in pressure on the sensor 78, suggesting the patient's feet are on the floor and/or support surface. As described above, the control unit may prevent articulation of the seat 43*a* until is it confirmed that the patient's feet are touching the floor.

Sensors 78 may also be utilized to automatically start and stop the articulation of the seat based on the location and/or position of the patient. For example, sensors 78, such as load cells and/or pressure sensors, may be mounted to the mattress 49, patient support deck 38, and/or the support structure 32. The sensors may be coupled to the controller 52, and the controller 52 may be configured to calculate and/or derive the patient's location relative to the patient support deck 38. For example, the controller 52 may be configured to calculate the center of gravity of the patient or object on the patient support apparatus 30 based on the data collected by a plurality of load cells 78. The controller 52 may be further configured to recognize when the patient's center of gravity is proximate the seat 43*a*, and the controller 52 may automatically articulate the seat 43*a* from the bed configuration to the egress configuration. The controller 52 may be configured to delay the automatic articulation of the seat 43*a* for a predefined amount of time, such as 1 minute, to provide the patient time to get into position and properly balance and/or brace for the transition to the egress position. Alternative, the mattress 49 may comprise a plurality of pressure sensors 78 coupled to the controller 52, wherein the controller 52 is configured to automatically articulate the seat 43 when the pressure sensors 78 detect the combination of pressure on the seat section 43 and an absence of pressure on the back section 41 and/or leg section 45. Other patient conditions and/or states of the patient support apparatus 30 could be monitored by the controller 52 such that the controller 52 automatically triggers starting/stopping articulation of one or more of the seats based on the patient condition and/or states.

The data collected by the one or more sensors may further be utilized by the controller 52 to calculate and/or derive information about the patient. The load and/or pressure sensor may be utilized by the controller 52 to determine or estimate the patient's weight. Furthermore, by detecting when the patient's feet are touching the floor, the controller 52 may be configured to calculate and/or estimate the patient's height based on the known height of the support deck 38. The height of the support deck may be determined by the controller 52 by utilizing a Hall Effect sensor, or similar sensor, coupled to the lift mechanism and/or actuator 42, 46 described above.

Figure 19:
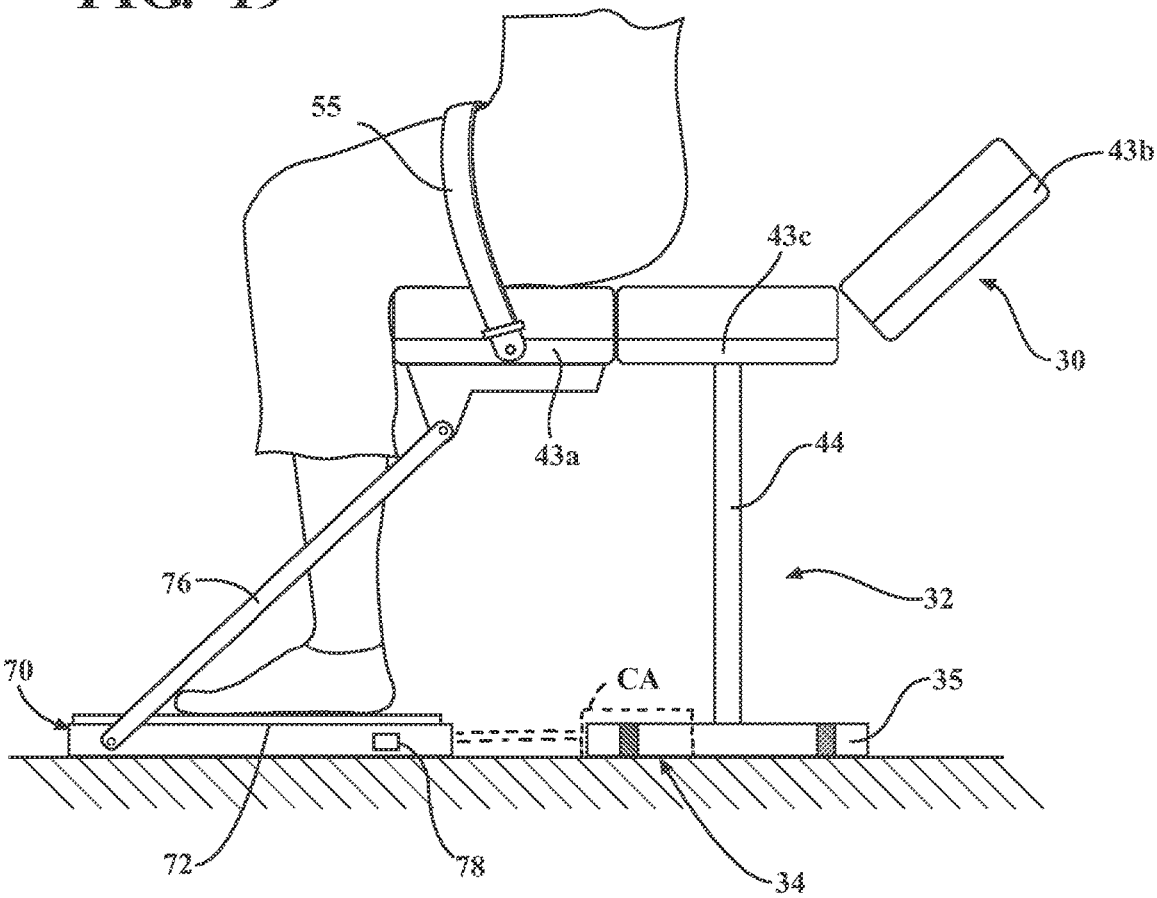
FIG. 19 is an illustration of an alternative embodiment of the patient support apparatus of FIG. 6 including a carrier assembly.
Figure 20:
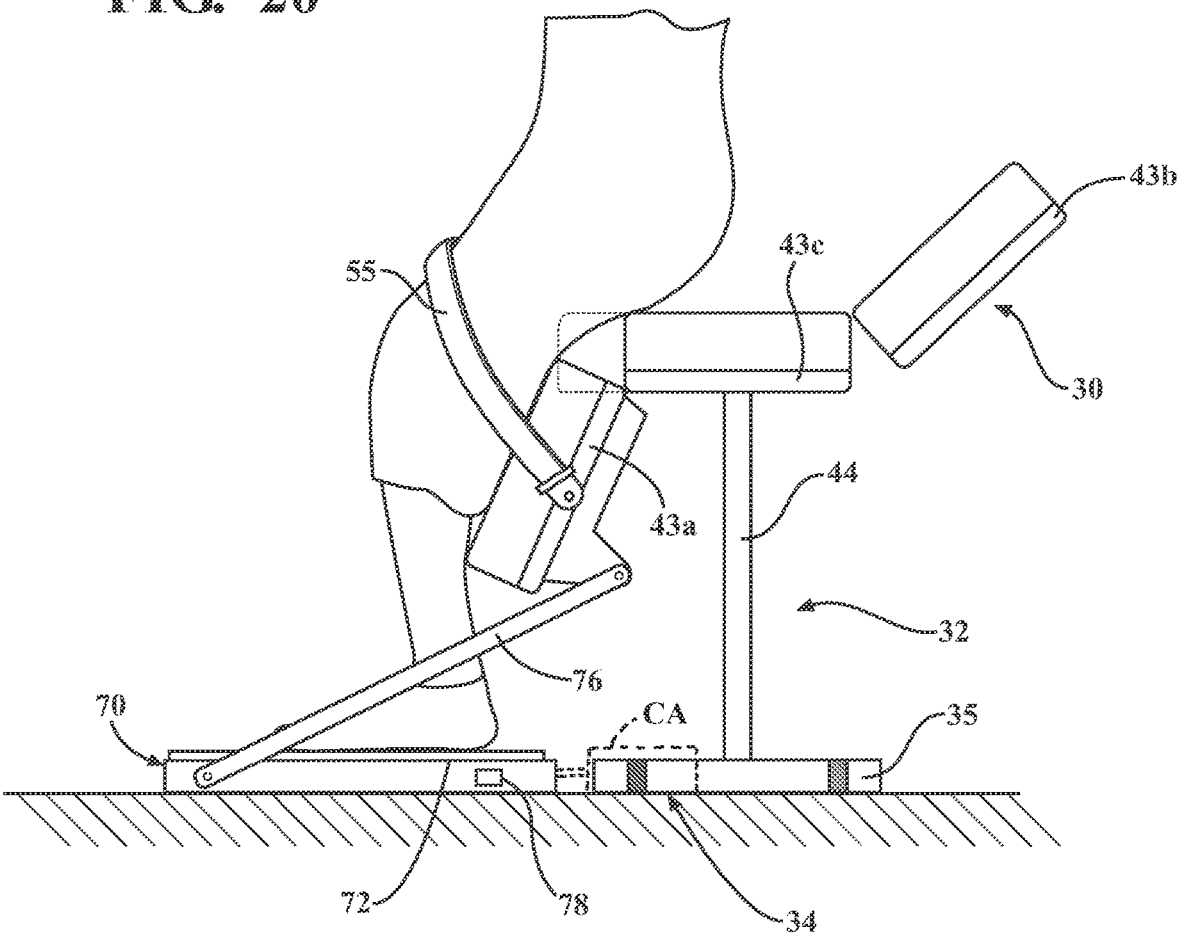
FIG. 20 is an illustration of the patient support apparatus of FIG. 19 in an egress configuration.

FIGS. 19 and 20 illustrate a carrier assembly 70. The carrier assembly 70 may be removably secured to the patient support apparatus 30, allowing the carrier assembly 70 to be removed based on a patient's required level of assistance when entering and exiting the patient support apparatus 30. For example, if the patient requires additional help exiting the patient support apparatus 30, the carrier assembly 70 may be attached to the patient support apparatus 30. Alternatively, the carrier assembly 70 may be removed from the patient support apparatus if the articulating seat 43 allows the patient to enter and exit the bed without the carrier assembly 70. The carrier assembly 70 comprises a carrier 72 or foot support that is operatively attached to the base 34, support frame 36, patient support deck 38 proximate the seat section 43, and/or any other suitable location of the patient support apparatus 30. The carrier assembly 70 may be pivotally connected to the seat section 43 or connected in any manner to provide support to a patient during ingress and/or egress. For example, as illustrated in the Figures, the carrier assembly 70 may be connected to the seat section 43 of the patient support deck 38 by a carrier linkage 76, or similar structure. The carrier assembly 70 is configured to support the patient's lower extremities (feet/legs) when the patient is entering or exiting the patient support apparatus 30 and to generally mimic a patient's normal motion for standing and/or sitting. Similarly, the carrier assembly 70 may be configured to support the patient's lower extremities (feet/legs) when the patient is entering or exiting the patient support apparatus 30 so that the patient's center of gravity is over their feet to ready them for ambulation away from the patient support apparatus 30. The shape and arrangement of the carrier linkage 76 may be configured to move the carrier 72 as the seat 43*a* is articulated. In the embodiment illustrated, the carrier linkage 76 is configured to slide the carrier 72 along the floor relative to the base 34 as the seat 43*a* is articulated. For example, as the seat 43*a* is articulated downward and the support deck 38 is simultaneously raised via the lift mechanism, the linkage 76 is configured to pull the carrier closer to the base 34 (compare FIG. 20 to FIG. 19). Alternatively, if the seat 43*a* were articulated upward and the patient support deck 38 were lowered via the lift mechanism, the linkage 76 may extend the carrier 72 away from the base 34. By pulling the carrier 72 closer to the base 34 as the seat 43*a* is articulated downward into the egress configuration, the patient's lower extremities, which are supported by the carrier 72, are moved underneath the support patient to help the patient to exit the patient support apparatus 30 and ambulate away from the patient support apparatus 30. The carrier may be configured to be pulled or retracted back when the seat section 43*a* is articulated to bring the patient's feet under their hips as they exit the patient support apparatus 30.

It is further contemplated that the carrier 72 may be supported by tracks or rails, wherein the carrier 72 is configured to move along the tracks and/or rails as the seat 43 is articulated. The tracks and/or rails may be configured to be coupled to the patient support apparatus 30 and to rest upon the floor or similar support surface. The tracks and/or rails may also be mounted to the patient support apparatus 30 in a cantilever-like configuration wherein the portion of the tracks and/or rails extending away from the patient support apparatus 30 float above the floor or support surface. For example, the tracks and/or rails may be coupled to the base 34 and extend outward from the side of the patient support apparatus 30, wherein the tracks and/or rails float above the floor. The carrier may then move along the path defined by the tracks and/or rails when the seat 43*a* is articulated. The tracks and/or rails may be configured to slide, fold, and/or retract to a stored positioned when not in use. Alternatively, the tracks and/or rails may be separate from the patient support apparatus 30, wherein the tracks and/or rails are fixed to the floor or similar support apparatus, and the patient support apparatus 30 is configured to be removably secured proximate the tracks and/or rails when the carrier 72 is needed by the patient to enter or exit the patient support apparatus 30.

In alternative embodiments, the carrier assembly 70 may also include a carrier actuator CA operatively attached to the carrier 72. See, for example, the electric linear actuator shown in FIGS. 19 and 20 by broken lines, which is fixed at one end to the base 34 and to the carrier 72 at the other end. The carrier actuator CA may be coupled to the controller 52 and configured to manipulate the movement of the carrier 72 relative to the articulation of the seat 43*a* in the same manner previously described. For example, the controller 52 may be configured to engage the carrier actuator CA to slide the carrier 72 along the floor as the seat section 43 transitions from the bed configuration to the egress configuration, and vice versa. For example, as the seat 43*a* is articulated to the egress configuration, and the patient support deck 38 is raised to boost the patient, the carrier 72 may be pulled inward toward the base 34, bringing the patient's feet underneath them as they exit the patient support apparatus 30. Alternatively, the carrier 72 may be extended away from the base 34, when the patient is entering the patient support apparatus 30. The carrier assembly 70 may include a hinge or similar apparatus configured to allow the carrier 72 to be folded or stored out of the way when not in use.

The carrier assembly 70 may also incorporate one or more sensors 78 configured to detect the presence of a patient. For example, the carrier 72 may include a load cell, weight sensor, pressure sensor, optical sensor, infrared sensor, or motion sensor 78. The sensor 78 may be coupled to the controller 52. The controller 52 may be configured to operate the carrier assembly 70 and the seat 43*a* based on the detection of the patient by the sensor 78. For example, if the sensor 78 fails to detect the patient, suggesting the patient does not have their feet on the carrier 72, the controller 52 may prevent the seat 43*a* from articulating until the patient is detected by the sensor 78. Similarly, if the sensor 78 does not detect the patient on the carrier 70, the controller 52 may lower the patient support apparatus 30 until the patient's feet are detected by the sensor 78 on the carrier 70, before proceeding with articulation of the seat 43*a*.

The patient support apparatus may further include a support belt 55 attached to the patient support deck 38. The support belt 55 may include opposing ends secured to the patient support deck 38 and is configured to extend across the seat section 43 and be oriented to be generally parallel to the longitudinal axis L2 of the patient support deck 38. The support belt 55 may include a buckle system positioned at any point along the length support belt 55 between the opposing ends. The buckle system may be configured such that the support belt 55 is split into two segments, and to re-attach the two segments, allowing the support belt 55 to be removably secured across the patient. For example, as illustrated in FIGS. 19 and 20, the opposing ends of the support belt 55 may be attached to the opposing ends of the seat section 43*a*, wherein the support belt is configured to extend across the patient's waist, midline, hips, thigh, or the like to secure the patient to the seat section 43. The support belt 55 removably secures the patient to the seat section 43 when the seat section 43 is articulated between the bed configuration and egress configuration, or vice versa. The buckle system, which may be similar to those included as part of a seat belt of a vehicle, will allow the patient to be secured by the support belt 55 when the seat section 43 is articulated, and then allow the support belt to be removed from the patient when laying on the patient support apparatus 30. It is contemplated that one or more support belts 55 may be utilized to secure the patient to the seat section 43 when articulated from the bed configuration to the egress configuration. It is further contemplated that the support belt 55 may be attached at any suitable location of the patient support apparatus 30. For example, a first support belt 55 may be secured to and extend across the first seat 43*a*, and a second support belt 55 may be secured to and extend across the second seat 43*b*.

Figure 21:
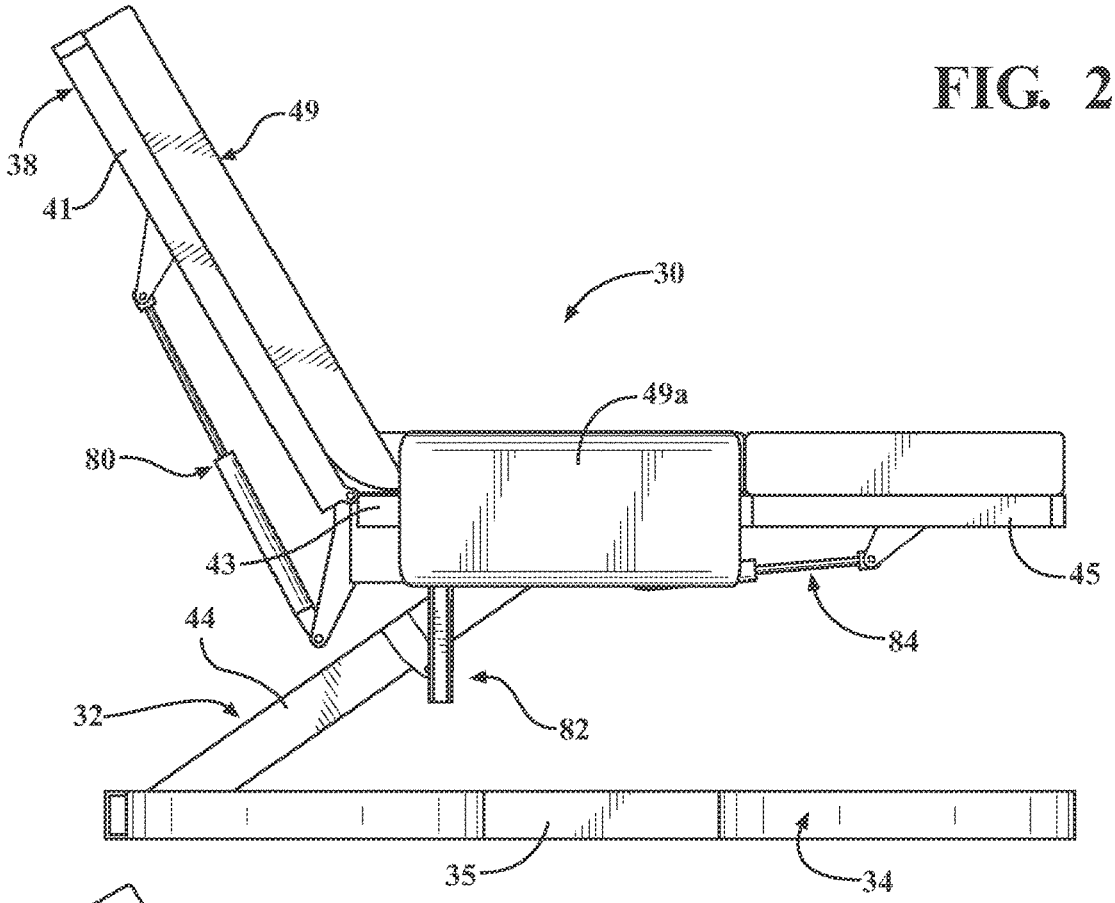
FIG. 21 is a side view of the patient support apparatus of FIG. 6 in an egress configuration.
Figure 22:
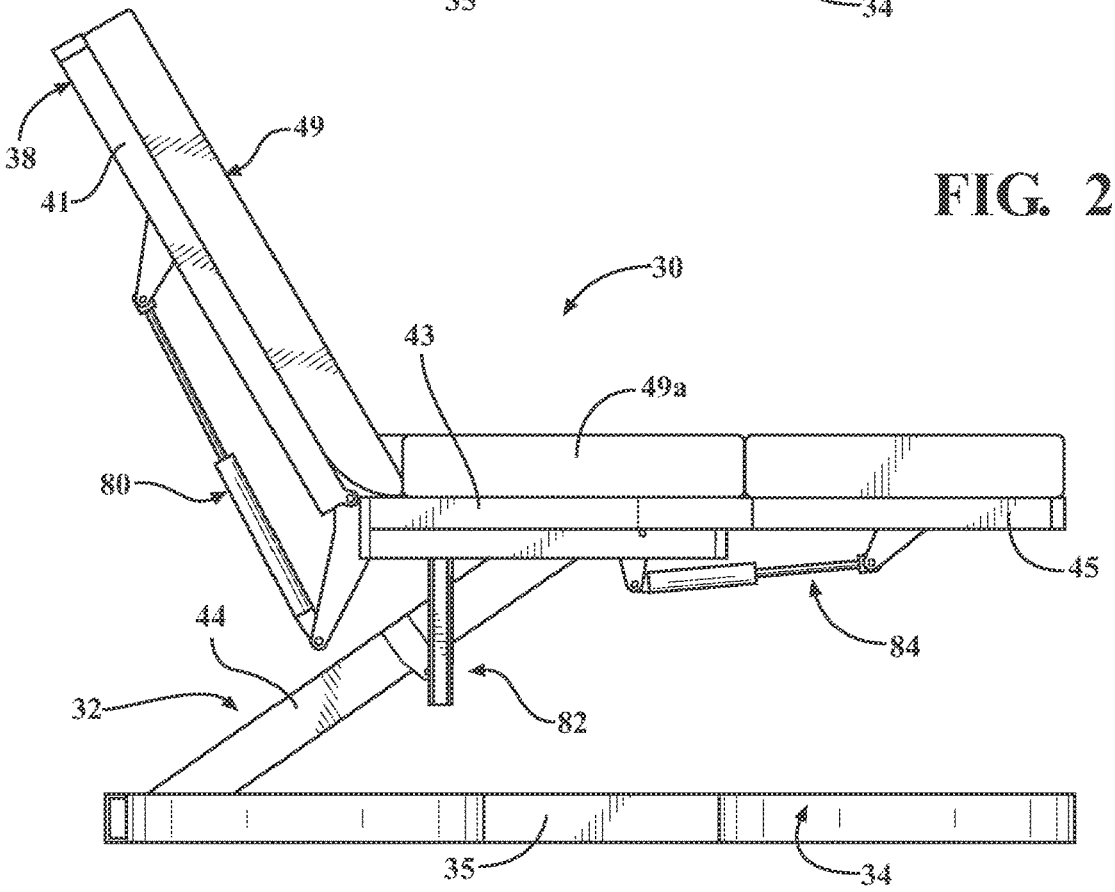
FIG. 22 is a side view of the patient support apparatus of FIG. 6 in a bed configuration.
Figure 25:
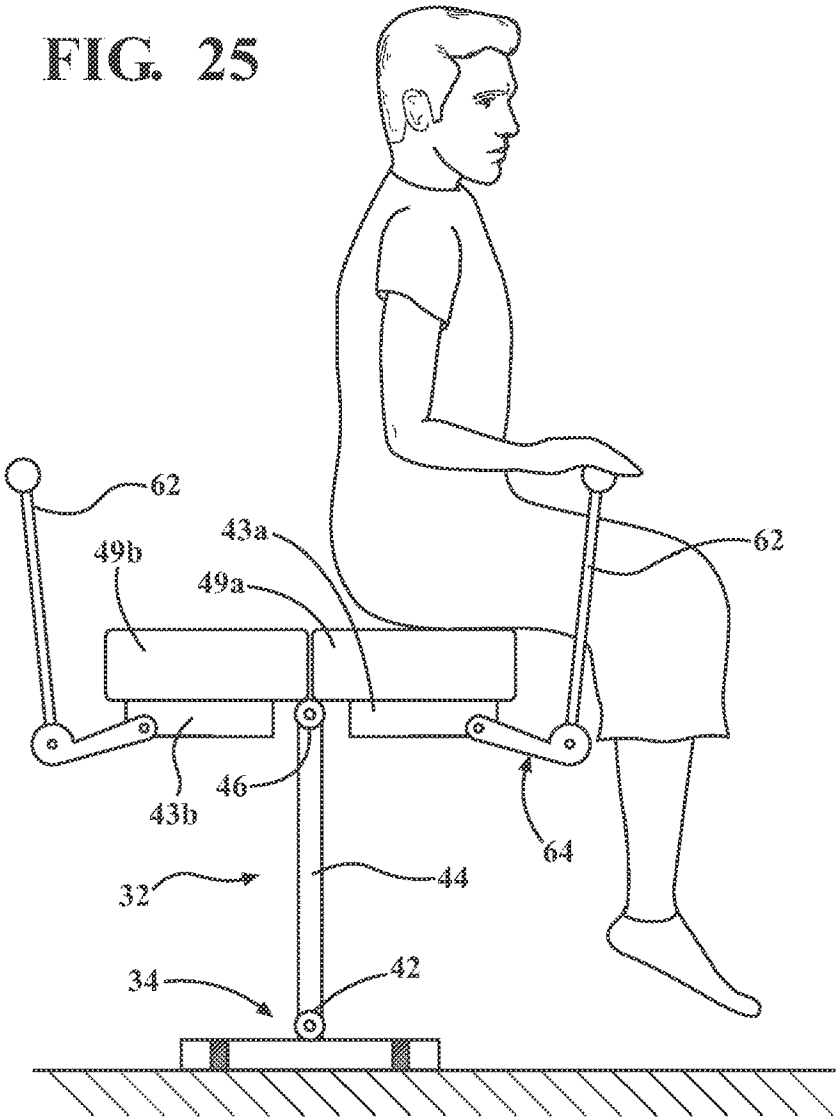
FIG. 25 is a sectional view of a patient support apparatus in a bed configuration.
Figure 26:
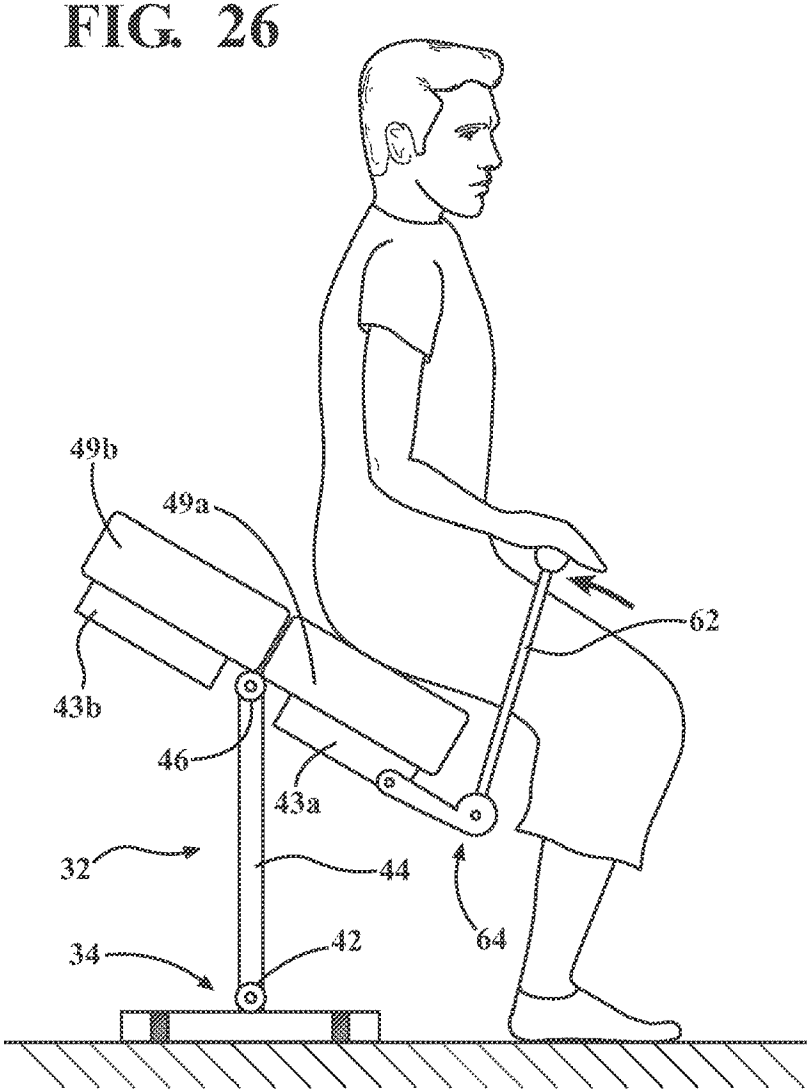
FIG. 26 is a sectional view of the patient support apparatus of FIG. 25 in an egress configuration.

FIGS. 21 and 22 illustrate side views of the patient support apparatus 30 in the egress configuration and the bed configuration, respectively.

FIGS. 23-26 illustrate embodiments of the patient support apparatus 30 including one or more handles 62. The handles 62 may be operably connected to the seat section 43, wherein manipulation of the handle 62 will transition the first and/or second seat 43*a*, 43*b* from the bed configuration (see, e.g., FIG. 25) to the egress configuration (see, e.g., FIG. 26). The handles 62 may be connected to the seat section 43 via a mechanical linkage 64 or an actuator 82 (like previously shown) may be configured to articulate the seat 43*a*. For example, when the patient pulls the handle 62 toward the seat section 43, the mechanical linkage 64 or actuator 82 may be engaged to articulate one or more of the seat sections 43*a*, 43*b*. Alternatively, the mechanical linkage 64 or actuator 82 may be configured to articulate the seat sections 43*a*, 43*b* when the patient pushes the handle 62 away/outward from the seat section 43.

FIG. 24 illustrates one embodiment of the mechanical linkage 64 configured to transition the seat section 43 from the bed configuration to the egress configuration. The mechanical linkage 64 may include a shaft 66, rod, or the like interconnected between the handle 62 and a pivot arm 68. The shaft 66 may be configured to rotate the pivot arm 68 when the handle 62 is manually pulled/manipulated, causing the pivot arm to articulate the seat 43*a*. The manual pulling of the handle will engage the mechanical linkage to articulate the seat 43*a*.

Figure 27:
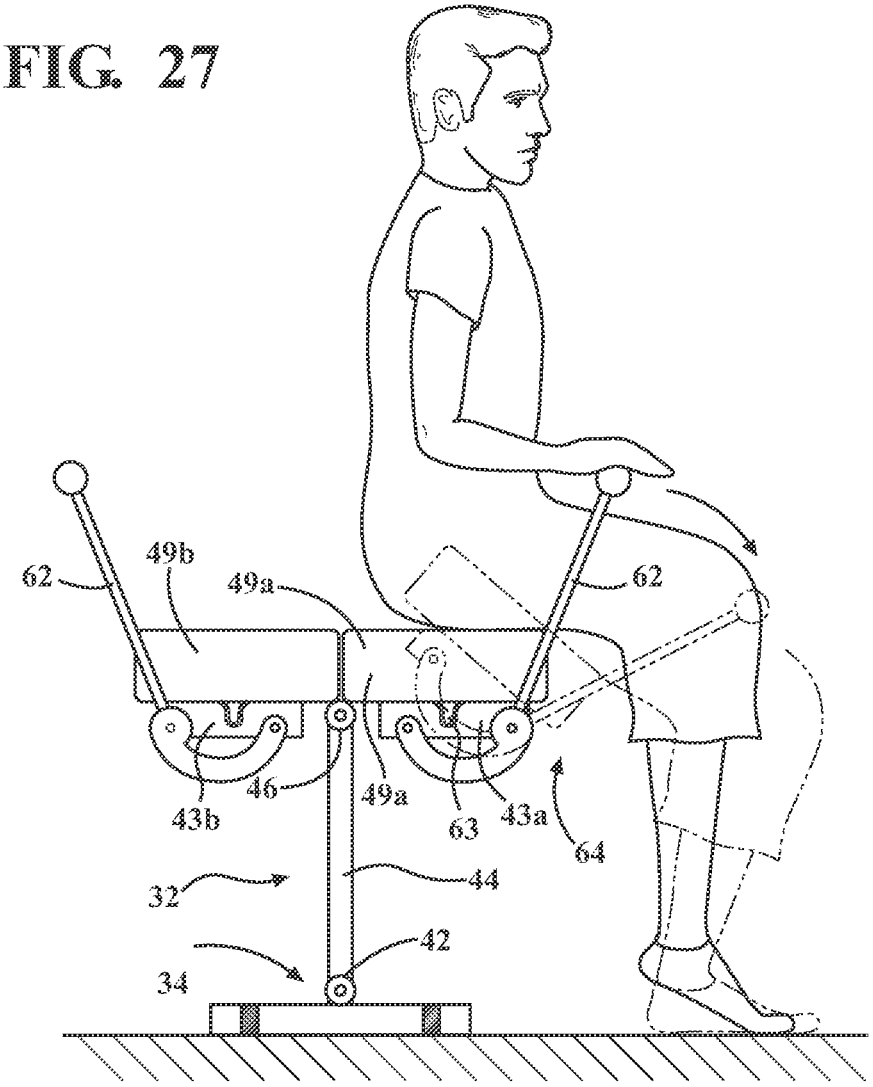
FIG. 27 is a sectional view of a patient support apparatus comprising an alternative mechanical linkage.

Alternatively, FIG. 27 illustrates an alternative embodiment of the mechanical linkage 64 wherein the mechanical linkage 64 is configured to articulate the seat 43*a* when the handle 62 is pushed outward and generally away from the patient support apparatus 30. For example, as the handle 62 is pushed away, the mechanical linkage 64 may generally rock or elevate the rear portion of the seat 43*a*, proximate the longitudinal axis L2 of the patient support apparatus, in a generally upward direction to mimic the patient's normal motion for standing.

In other embodiments wherein the actuator 82 articulates the seat 43*a*, the handle 62 may be coupled to the controller 52 and/or the actuator 82, wherein the controller 52 is configured to engage the actuator 82 to articulate the seat 43*a* and/or 43*b* based on the manipulation of the handle 62 by the patient. In this embodiment, the manual manipulation of the handle 62 engages the powered actuator 82 via the controller to articulate the seat 43*a*. The directionality that the handle 62 is manipulated may be configured to control the direction the seat 43*a* is articulated. For example, the controller 52 may be configured to articulate the seat 43*a* from the bed configuration to the egress configuration when the handle 62 is pushed forward and away from the support deck 38. Conversely, the controller 52 may be configured to articulate the seat 43*a* from the bed configuration to the egress configuration when the handle 62 is pulled back toward the support deck 38. Alternatively, controller 52 may be configured to articulate the seat 43*a* from the bed configuration to the egress configuration when the handle 62 is pulled, and to articulate the seat 43*a* from the bed configuration to the egress configuration when the handle 62 is pushed.

Referring to FIG. 27, a handle 62 may be included on opposing left and right sides of the seat section 43 so that the patient may exit from either side of the patient support apparatus 30. The patient support apparatus 30 may be configured to have independent mechanical linkages for each seat 43*a* and 43*b*, wherein manipulation of the handle on the right side of the patient support apparatus 30 will manually articulate seat 43*a* in a generally downward direction to egress on the right, and manipulation of the handle on the left side of the patient support apparatus 30 will manually articulate seat 43*b* in a generally downward direction to egress on the left. Alternatively, a power actuator system may be utilized with the two handle model. For example, the controller 52 and/or actuator 82 described above may be configured to articulate the seats 43*a*, 43*b* to change the seat section 43 from a bed configuration to an egress configuration based on the whether the patient manipulates the handle 62 on the left or right side of the patient support apparatus 30.

The patient support apparatus 30 may also include a pair of handles 62 on one side of the patient support apparatus 30, one proximate the back section 41 and the other proximate the foot section 45, to allow the patient to grasp a handle 62 with each hand as they exit the patient support apparatus 30. Similar to the embodiment described above, manipulation of the handles 62 may engage a manual mechanical linkage system, or a powered actuator system to articulate the seat 43*a*, 43*b*, 43*c*. In the embodiment with two handles 62 on the same side, different handles may be configured to articulate different seats 43*a*, 43*b*, 43*c*. For example, the handle 62 proximate the back section 41 may be configured to articulate the first seat 43*a*, and the handle 62 proximate the foot section 45 may be configured to articulate the second seat 43*b*, or vice versa.

The handle(s) 62 described above may further be configured to include buttons, switches, or the like to provide commands to the controller related to the manipulation of the seat 43. The buttons may be coupled to the controller 52 and configured to articulate the seats 43*a*, 43*b*, 43*c* as described above. The handle may be pushed in one direction to cause the associated seat to articulate in a first direction toward the side-egress configuration and the handle may be pushed in an opposing direction to cause the associated seat to articulate in a second direction, opposite the first direction and toward the bed configuration. Various arrangements of sensors may be employed for this purpose. The handle 62 may be pivotally connected to the patient support deck 38 so that the handle 62 may be rotated out of the way when not in use, as shown in FIG. 23. The handle 62 may also be integrated into one or more of the side rails 48, 50, as shown in broken lines in FIG. 1.

Several embodiments have been discussed in the foregoing description. However, the embodiments discussed herein are not intended to be exhaustive or limit the invention to any particular form. The terminology which has been used is intended to be in the nature of words of description rather than of limitation. Many modifications and variations are possible in light of the above teachings and the invention may be practiced otherwise than as specifically described.

What is claimed is:

1. A patient support apparatus comprising:

a base;

a patient support deck supported by the base and comprising a deck section having a first portion and a second portion configured to articulate relative to the first portion to transition between a bed configuration and a side-egress configuration, and including a third portion positioned between the first portion and the second portion;

an actuator system coupled to the deck section and configured to articulate the second portion;

wherein the first portion, the second portion, and the third portion are substantially co-planar when in the bed configuration; and wherein the second portion is configured to articulate relative to the first portion as the actuator system transitions the deck section from the bed configuration to the side-egress configuration.

2. The patient support apparatus of claim 1, further comprising a lift mechanism extending from the base and operatively connected to the patient support deck, the lift mechanism configured to raise and lower the patient support deck relative to the base.

3. The patient support apparatus of claim 2, further comprising a controller coupled to the lift mechanism and configured to control the lift mechanism to raise the patient support deck relative to the base as the deck section transitions to the side-egress configuration.

4. The patient support apparatus of claim 3, wherein the controller is coupled to the actuator system and configured to control articulation of the second portion to transition the deck section from the bed configuration to the side-egress configuration.

5. The patient support apparatus of claim 4, wherein the actuator system comprises a first actuator operatively attached to the first portion and a second actuator operatively attached to the second portion.

6. The patient support apparatus of claim 5, wherein the controller is configured to operate at least one of the first actuator and the second actuator to articulate the second portion to transition the deck section from the bed configuration to the side-egress configuration.

7. The patient support apparatus of claim 3, further comprising a carrier assembly comprising:

a carrier; and a carrier actuator operatively connected to the carrier to move the carrier relative to the base, wherein the carrier is to be positioned adjacent a floor surface as the deck section transitions from the bed configuration to the side-egress configuration to support a patient.

8. The patient support apparatus of claim 7, wherein the controller is coupled to the carrier actuator and configured to coordinate movement of the carrier with articulation of the second portion.

9. The patient support apparatus of claim 8, wherein the carrier assembly further comprises a sensor attached proximate to the carrier to detect contact between the patient and the carrier.

10. The patient support apparatus of claim 9, wherein the sensor is one of a load cell, weight sensor, pressure sensor, optical sensor, infrared sensor, or motion sensor.

11. The patient support apparatus of claim 7, wherein the controller is coupled to the carrier actuator and configured to coordinate movement of the carrier with the articulation of the second portion and raising of the patient support deck.

12. The patient support apparatus of claim 1, wherein the first portion and the second portion comprise mating features configured to define a saddle to support a patient when the deck section is transitioning to the side-egress configuration.

13. The patient support apparatus of claim 1, further comprising a support belt attached to the deck section, the support belt configured to extend across the deck section and secure a patient when the deck section transitions from the bed configuration to the side-egress configuration.

14. The patient support apparatus of claim 1, wherein the first portion is configured to articulate relative to the second portion to transition between the bed configuration and the side-egress configuration.

15. The patient support apparatus of claim 1, further comprising:

a lift mechanism extending from the base and operatively connected to the patient support deck, the lift mechanism configured to raise and lower the patient support deck relative to the base;

a controller coupled to the lift mechanism and configured to control the lift mechanism to raise the patient support deck relative to the base as the deck section transitions to the side-egress configuration; and wherein the controller is coupled to the actuator system and configured to control articulation of the first portion and the second portion to transition the deck section between the bed configuration and the side-egress configuration.

16. The patient support apparatus of claim 15, wherein the controller is configured to control the actuator system to articulate the first portion in a generally upward direction relative to the third portion, articulate the second portion in a generally downward direction relative to the third portion, with the third portion remaining substantially horizontal when transitioning the deck section to the side-egress configuration.

17. A patient support apparatus comprising:

a base;

a patient support deck supported by the base and comprising a deck section having a first portion and a second portion configured to articulate relative to the first portion to transition between a bed configuration and a side-egress configuration, and including a third portion positioned between the first portion and the second portion;

an actuator system coupled to the deck section and configured to articulate the second portion;

a lift mechanism extending from the base and operatively connected to the patient support deck, the lift mechanism configured to raise and lower the patient support deck relative to the base;

a controller coupled to the lift mechanism and configured to control the lift mechanism to raise the patient support deck relative to the base as the deck section transitions to the side-egress configuration;

a carrier assembly comprising:

a carrier; and a carrier actuator operatively connected to the carrier to move the carrier relative to the base, wherein the carrier is to be positioned adjacent a floor surface as the deck section transitions from the bed configuration to the side-egress configuration to support a patient;

wherein the first portion, the second portion, and the third portion are substantially co-planar when in the bed configuration;

wherein the second portion is configured to articulate relative to the first portion as the actuator system transitions the deck section from the bed configuration to the side-egress configuration; and wherein the controller is coupled to the carrier actuator and configured to coordinate movement of the carrier with articulation of the second portion.

18. A patient support apparatus comprising:

a base;

a patient support deck supported by the base and comprising a deck section having a first portion and a second portion configured to articulate relative to the first portion to transition between a bed configuration and a side-egress configuration, and including a third portion positioned between the first portion and the second portion;

an actuator system coupled to the deck section and configured to articulate the second portion;

a lift mechanism extending from the base and operatively connected to the patient support deck, the lift mechanism configured to raise and lower the patient support deck relative to the base;

a controller coupled to the lift mechanism and configured to control the lift mechanism to raise the patient support deck relative to the base as the deck section transitions to the side-egress configuration;

wherein the first portion, the second portion, and the third portion are substantially co-planar when in the bed configuration;

wherein the second portion is configured to articulate relative to the first portion as the actuator system transitions the deck section from the bed configuration to the side-egress configuration;

wherein the controller is coupled to the actuator system and configured to control articulation of the first portion and the second portion to transition the deck section between the bed configuration and the side-egress configuration; and wherein the controller is configured to control the actuator system to articulate the first portion in a generally upward direction relative to the third portion, articulate the second portion in a generally downward direction relative to the third portion, with the third portion remaining substantially horizontal when transitioning the deck section to the side-egress configuration.

* * * * *